US010631584B2

(12) United States Patent
LeMarbe

(10) Patent No.: US 10,631,584 B2
(45) Date of Patent: Apr. 28, 2020

(54) APPARATUS INCLUDING A QUICK-RELEASE FASTENER AND PULL CORD

(71) Applicant: Point Blank Enterprises, Inc., Pompano Beach, FL (US)

(72) Inventor: Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 0 days.

(21) Appl. No.: 15/905,970

(22) Filed: Feb. 27, 2018

(65) Prior Publication Data

US 2018/0184733 A1 Jul. 5, 2018

Related U.S. Application Data

(63) Continuation-in-part of application No. 14/609,049, filed on Jan. 29, 2015, now Pat. No. 9,901,127.

(60) Provisional application No. 62/024,640, filed on Jul. 15, 2014.

(51) Int. Cl.
*A41D 13/05* (2006.01)

(52) U.S. Cl.
CPC ..... *A41D 13/0568* (2013.01); *A41D 13/0518* (2013.01); *A41D 2300/32* (2013.01)

(58) Field of Classification Search
CPC .... A41F 1/00; A41F 9/00; A41F 9/002; F41H 1/02; F41H 1/002; A41D 13/0518; A41D 13/0562; A41D 1/04; A41D 2300/32; A41D 2300/33; A41D 13/0556; A41D 13/0568; A41D 13/0512; Y10T 24/1397; Y10T 247/27; Y10T 24/2708; Y10T 24/39; Y10T 24/3982; Y10T 24/3991
USPC .... 2/102, 463, 465, 2.5, 309, 310, 311, 319, 2/322
See application file for complete search history.

(56) References Cited

U.S. PATENT DOCUMENTS 3,557,384 A * 1/1971 Barron et al. ..... F41H 1/02 2/2.5
4,183,097 A * 1/1980 Mellian ..... F41H 1/02 2/2.5
4,497,069 A * 2/1985 Braunhut ..... F41H 1/02 2/2.5
5,373,582 A * 12/1994 Dragone ..... F41H 1/02 2/102

(Continued)

OTHER PUBLICATIONS

Office Action for U.S. Appl. No. 14/609,049 dated Apr. 20, 2016.

(Continued)

*Primary Examiner* — Heather N Mangine
(74) *Attorney, Agent, or Firm* — Honigman LLP

(57) ABSTRACT

A system includes an article of clothing, a pull cord, and a quick-release fastener. The article of clothing defines a shoulder region having a conduit. The pull cord is movably-supported upon the shoulder region. The quick-release fastener includes a peelable portion directly connected to a peelable end of the pull cord and a fixed portion directly connected to the shoulder region of the article of clothing. Another system includes a vest having a shoulder region and a waist region. A first quick-release assembly is arranged upon the shoulder region of the vest, and a second quick-release assembly arranged upon the waist region of the vest.

21 Claims, 44 Drawing Sheets

(56) References Cited

U.S. PATENT DOCUMENTS 5,586,969 A * 12/1996 Yewer, Jr. ..... A61F 5/028 128/101.1
5,690,609 A * 11/1997 Heinze, III ..... A61F 5/028 128/115.1
5,785,011 A * 7/1998 Gitterman, III ..... B68B 1/02 119/865
6,137,675 A * 10/2000 Perkins ..... G06F 1/163 128/876
6,419,652 B1 * 7/2002 Slautterback ..... A61F 5/028 128/96.1
6,434,802 B1 * 8/2002 Pannone ..... A41F 1/02 2/128
6,755,799 B2 * 6/2004 Toda ..... A61F 5/028 2/311
6,769,137 B2 * 8/2004 D'Annunzio ..... F41H 1/02 2/102
6,820,280 B1 * 11/2004 Atallah ..... A41D 1/04 2/102
7,047,570 B2 * 5/2006 Johnson ..... F41H 1/02 2/102
7,103,921 B1 * 9/2006 Shoemaker ..... A41F 9/00 2/312
7,401,363 B2 * 7/2008 Hatfield ..... F41H 1/02 2/2.5
7,473,235 B2 * 1/2009 Schwenn ..... A61F 5/0193 128/100.1
7,536,728 B1 * 5/2009 Leathers ..... F41H 1/02 2/2.5
7,900,278 B2 * 3/2011 Pittman ..... A45F 3/14 2/310
8,490,212 B1 * 7/2013 Asher ..... A41D 1/04 2/2.5
2010/0313327 A1 * 12/2010 Anscher ..... A44B 11/266 2/102
2011/0088225 A1 * 4/2011 Fernandez ..... A44B 18/0069 24/450
2013/0298318 A1 * 11/2013 Rogers ..... A42B 3/185 2/439
2015/0153140 A1 * 6/2015 Crye ..... F41H 1/02 2/102
2015/0237925 A1 * 8/2015 Sewell ..... A41D 13/0015 2/455

OTHER PUBLICATIONS

Office Action for U.S. Appl. No. 14/609,049 dated Aug. 5, 2016.
Office Action for U.S. Appl. No. 14/609,049 dated Apr. 6, 2017.
Office Action for U.S. Appl. No. 14/609,049 dated Jun. 13, 2017.

* cited by examiner

APPARATUS INCLUDING A QUICK-RELEASE FASTENER AND PULL CORD

CROSS REFERENCE TO RELATED APPLICATIONS

This U.S. patent application is a continuation-in-part of U.S. patent application Ser. No. 14/609,049 filed on Jan. 29, 2015, now U.S. Pat. No. 9,901,127 issued on Feb. 27, 2018, which claims priority under 35 U.S.C. § 119(e) to U.S. Provisional Application 62/024,640, filed on Jul. 15, 2014. The disclosures of these prior applications are considered part of the disclosure of this application and are hereby incorporated by reference in their entireties.

TECHNICAL FIELD

This disclosure relates to an apparatus including a quick-release fastener and a pull cord.

BACKGROUND

Structures including quick-release fasteners are known. While existing structures including quick-release fasteners perform adequately for their intended purpose, improvements to structures including quick-release fasteners are continuously being sought in order to advance the arts.

SUMMARY

One aspect of the disclosure provides an apparatus. The apparatus includes an article of clothing, a quick-release fastener and a pull cord. The article of clothing includes a first end and a second end. The article of clothing forms a conduit. The quick-release fastener includes a peelable portion supported by the first end of the article of clothing and a fixed portion supported by the second end of the article of clothing. The peelable portion is selectively-attached to and overlapped with the fixed portion. The pull cord is movably-supported upon the article of clothing and movably-arranged within the conduit. The pull cord includes a peelable end and a handle end. The peelable end of the pull cord supports the peelable portion of the quick-release fastener. The handle end of the pull cord extends outside of a first end of the conduit. The peelable end of the pull cord extends outside of a second end of the conduit. The peelable end of the pull cord that supports the peelable portion of the quick-release fastener extends across the fixed portion of the quick-release fastener for permitting selective detachment of the peelable portion from the fixed portion in response to a pulling force applied to the handle end of the pull cord.

Implementations of the disclosure may include one or more of the following features. In some implementations, the quick-release fastener is defined by a snap fastener. The peelable portion is defined by one of a male portion and a female portion of the snap fastener. The fixed portion is defined by the other of the male portion and the female portion of the snap fastener.

In some examples, the quick-release fastener is defined by a hook-and-loop fastener. The peelable portion is defined by one of a loop portion and a hook portion of the hook-and-loop fastener. The fixed portion is defined by the other of the loop portion and the hook portion of the hook-and-loop fastener.

In some instances, the peelable end of the pull cord is directly fastened to the peelable portion of the quick-release fastener. In some implementations, the peelable end of the pull cord is adjacently fastened to the peelable portion of the quick-release fastener. In some implementations, the peelable end of the pull cord is a distal end of the pull cord. The handle end of the pull cord is a proximal end of the pull cord having a user-engaging portion.

In some instances, the user-engaging portion includes a handle member secured to the proximal end of the pull cord. In other examples, the peelable end of the pull cord includes a pull stop member. In some implementations, each of the handle member and the pull stop member are defined by a dimension that is greater than a passage dimension of the conduit.

In some implementations, the article of clothing includes a base portion and a patch portion. A first side of the patch portion is secured to the base portion. A second side of the patch portion that is opposite the first side of the patch portion is secured to the base portion. A surface of the patch portion that directly faces a portion of an outer surface of the base portion at least partially defines the conduit.

In some examples, each of a first end of the patch portion and a second end of the patch portion are not secured to the base portion. The first end of the patch portion at least partially defines a proximal conduit opening that permits access to the first end of the conduit. The second end of the patch portion at least partially defines a distal conduit opening that permits access to the second end of the conduit.

In some instances, the article of clothing is a vest. The fixed portion of the quick-release fastener is attached to the vest. The vest includes a back portion and a front portion. The peelable portion and the fixed portion of the quick-release fastener are arranged upon the back portion of the vest when the peelable portion is selectively-attached to and overlapped with the fixed portion. The handle end of the pull cord is movably arranged upon the front portion of the vest. In other examples, the article of clothing is a cummerbund.

Another aspect of the disclosure provides an apparatus. The apparatus includes a substrate member, a quick-release fastener and a pull cord. The quick-release fastener has a peelable portion supported by a first end of the substrate member and a fixed portion supported by a second end of the substrate member. The peelable portion is selectively-attached to and overlapped with the fixed portion. The pull cord is fastened to the peelable portion of the quick-release fastener. The pull cord extends across the fixed portion of the quick-release fastener for permitting selective detachment of the peelable portion from the fixed portion.

Implementations of the disclosure may include one or more of the following features. In some implementations, the quick-release fastener is defined by a snap fastener. The peelable portion is defined by one of a male portion and a female portion of the snap fastener. The fixed portion is defined by the other of the male portion and the female portion of the snap fastener.

In some instances, the quick-release fastener is defined by a hook-and-loop fastener. The peelable portion is defined by one of a loop portion and a hook portion of the hook-and-loop fastener. The fixed portion is defined by the other of the loop portion and the hook portion of the hook-and-loop fastener.

In some examples, the pull cord is directly fastened to the peelable portion of the quick-release fastener. In other examples, the pull cord is adjacently fastened to the peelable portion of the quick-release fastener.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 4 shows the portion of the cummerbund that fastens to the first portion of the cummerbund shown in FIG. 2.

FIG. 11A shows the cummerbund before the user has engaged the frontal pull of the quick release fastening system.

FIG. 11B shows the cummerbund as the user has begun to engage the frontal pull of the quick release fastening system.

FIG. 11C shows the cummerbund as the user continues to engage the frontal pull of the quick release fastening system.

FIG. 11D shows the cummerbund after the user has completed engagement of the frontal pull of the quick release fastening system.

FIG. 13A shows the vest and cummerbund as the user has begun to engage the frontal pull of the quick release fastening system.

FIG. 13B shows the vest and cummerbund after the user has completed engagement of the frontal pull of the quick release fastening system.

FIG. 13C shows the vest and cummerbund after the user has completed engagement of the frontal pull of the quick release fastening system.

FIG. 15A shows an exemplary implementation of the quick release fastening system, in which a single pull cord is utilized for release of two fastening systems.

FIG. 15B shows an exemplary implementation of the quick release fastening system, in which a single pull cord is utilized for release of two fastening systems.

FIG. 15D shows the vest and cummerbund after the user has completed engagement of the frontal pull of the quick release fastening system.

FIG. 15E shows the vest and cummerbund after the user has completed engagement of the frontal pull of the quick release fastening system.

FIG. 16B shows the vest and cummerbund after the user has completed engagement of the front pull of the quick release fastening system.

Like reference symbols in the various drawings indicate like elements.

DETAILED DESCRIPTION

Figure 1A:
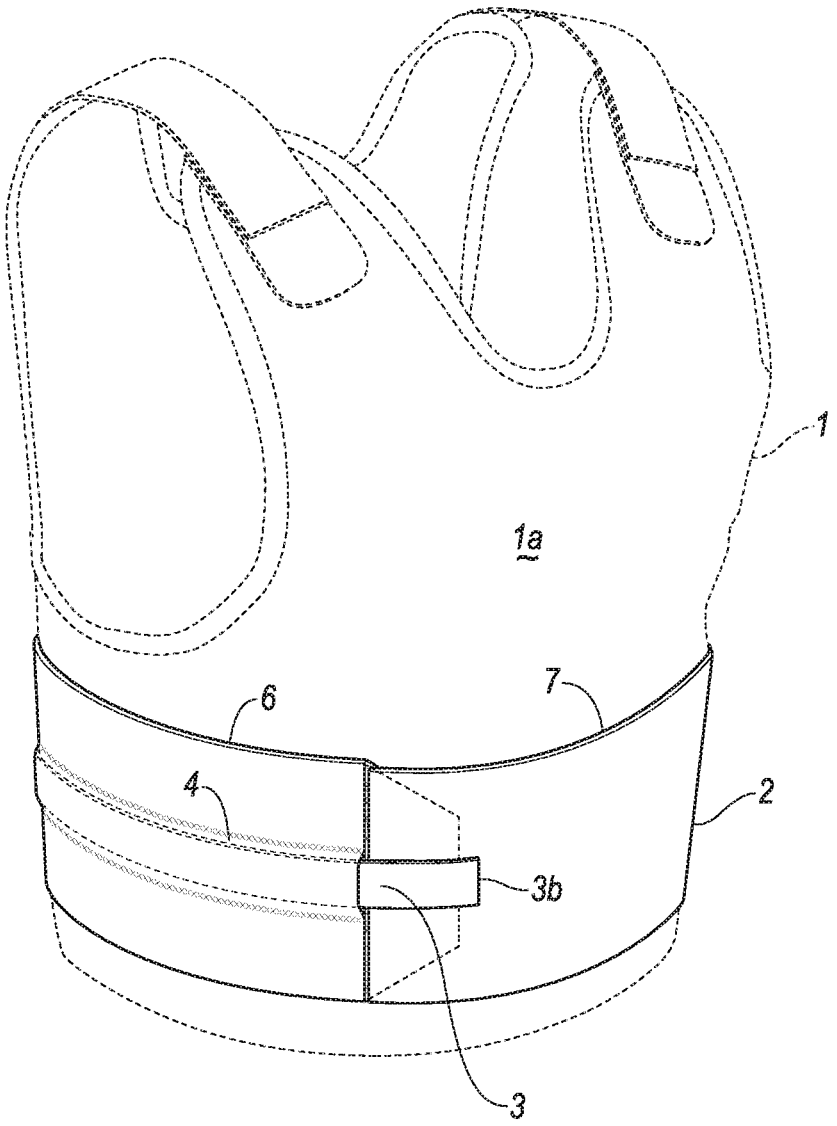
FIG. 1A is an isometric view of the front portion of a wearable article such as a vest including a cummerbund that utilizes an exemplary implementation of the quick release fastening system.

Exemplary embodiments of the invention are shown in FIGS. 1A, 1B, 9, 12A, 12B, 12C, 14A, 14B, 15A, 15B, 15C, and 16A. In these embodiments, the quick release fastening system is utilized to fasten and release two wearable articles, such as a cummerbund or elongated strap 2 associated with a vest 1. The vest 1 has a front portion 1*a* and a back portion 1*b*. The front portion 1*a* of the vest 1 can be, but need not be, attached to the back portion 1*b* of the vest 1.

The pull cord 3 has an opposing first end 3*a* (e.g., a peelable end) and second end 3*b* (e.g., a handle end). The second end 3*b* of the pull cord 3 is positioned at the front portion 1*a* of the vest 1. This positioning allows the user to engage the quick release mechanism of the fastening system with a frontal pull of the second end 3*b* of the pull cord 3.

The pull cord 3 extends from its second end 3*b* at the front portion 1*a* of the vest 1 to its first end 3*a*. In the exemplary embodiments, the pull cord 3 partially resides within a conduit 4, in order to maintain the positioning of the pull cord 3, its first end 3*a*, and its second end 3*b*. The conduit 4 may continuously extend from front portion 1*a* of the vest 1 to the back portion 1*b* of the vest 1. The conduit 4 may also consist of one or more straps. The invention can also be accomplished by maintaining the positioning of the pull cord 3 with other means, not requiring a conduit 4.

The conduit 4 is formed through the cummerbund 2. However, the quick release fastening system can also be accomplished with a conduit 4 that is attached to the cummerbund 2, utilizing any one of a variety of attachment means.

Figure 1B:
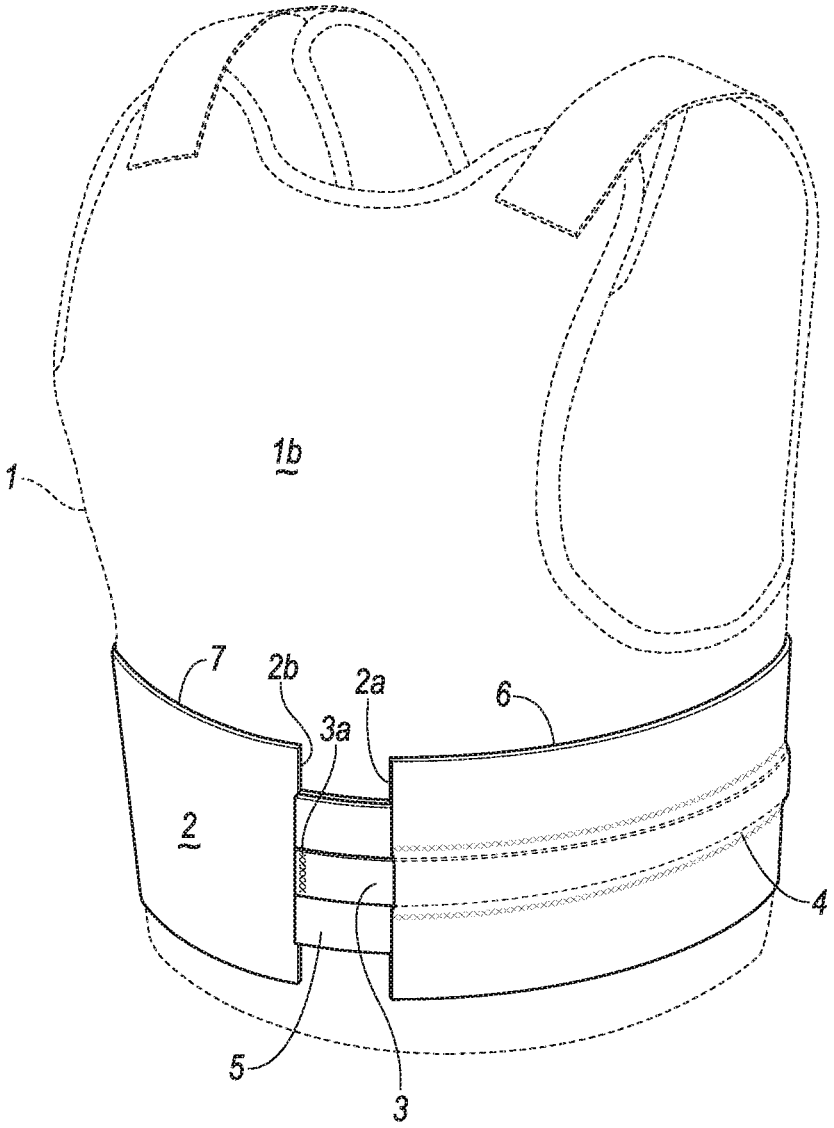
FIG. 1B is an isometric view of the back portion of a wearable article including a cummerbund that utilizes an exemplary implementation of the quick release fastening system.

Referring to FIGS. 1A and 1B, in some implementations, the cummerbund 2 is comprised of a first half 6 and a second half 7. The quick release fastening system utilizes a connector 5 to fastens the first half 6 of the cummerbund 2 to the second half 7 of the cummerbund 2 at the back portion 1*b* of the vest 1.

The first end 3*a* of the pull cord 3 is attached to the connector 5 at the back portion 1*b* of the vest 1.

The second end 3*b* of the pull cord 3 resides proximate to the front portion 1*a* of the vest 1. With a frontal pull of the second end 3*b* of the pull cord 3, the user is able to engage the quick release function of the fastening system. A user's engagement of the quick release function causes the first end 3*a* of the pull cord 3 to peel the connector 5 at the back portion 1*b* of the vest 1 to disengage the hook and loop fastener.

Figure 1C:
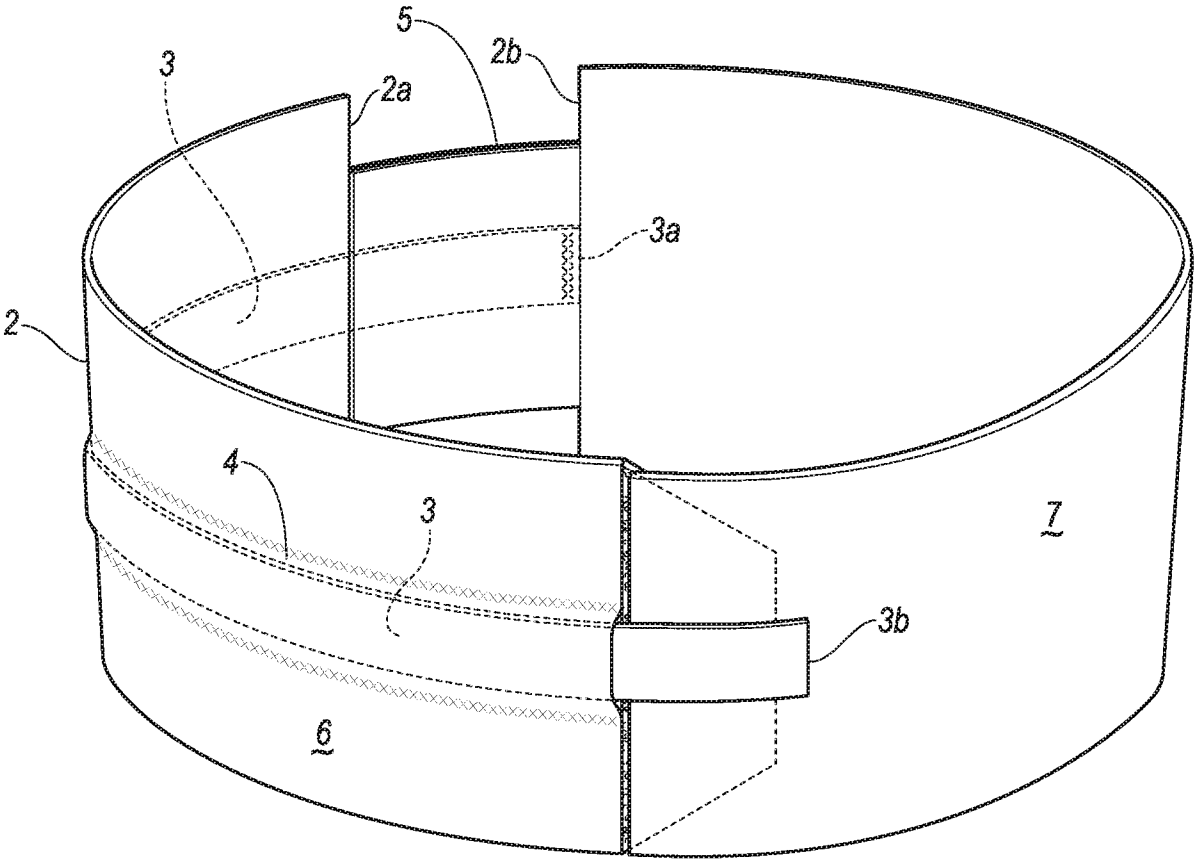
FIG. 1C is an isometric view of the cummerbund of FIGS. 1A and 1B.

Referring to FIG. 1C, in some implementations, the first half 6 and the second half 7 of the cummerbund 2 are fastened together to form the cummerbund 2 around a vest 1.

Referring to FIGS. 2, 3, 4, and 5, in some implementations, the cummerbund 2 has a two-piece design with a first half 6 of the cummerbund 2 and a second half 7 of the cummerbund 2. The pull cord 3 may partially reside within a conduit 4 formed through the first half 6 of the cummerbund 2.

Figure 2:
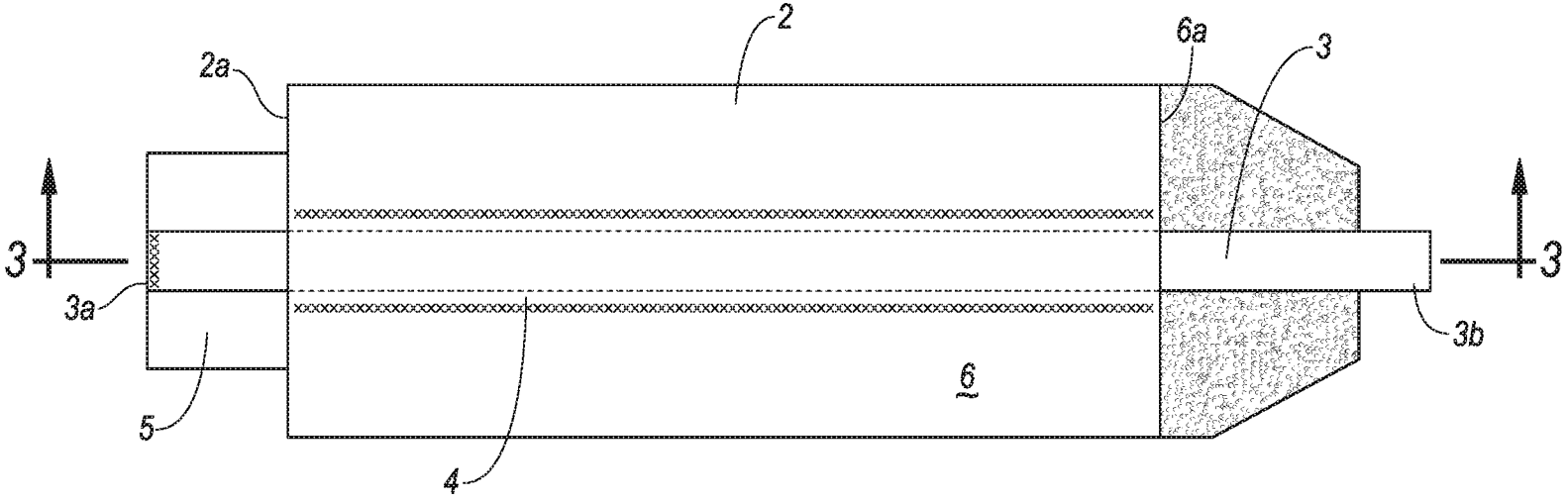
FIG. 2 is a plan view of one portion of the cummerbund of FIGS. 1A and 1B.
Figure 3:
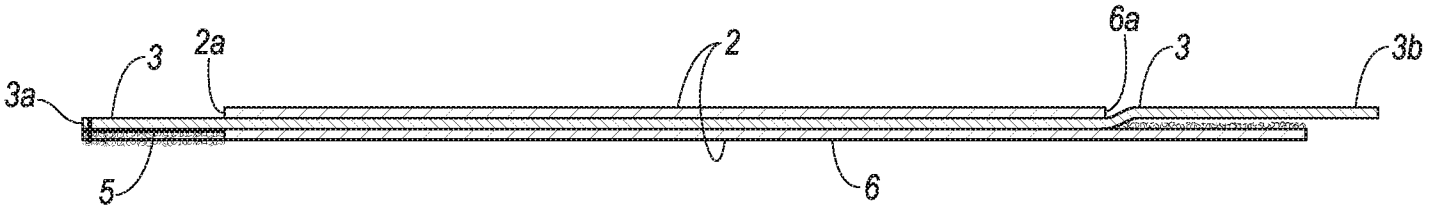
FIG. 3 is a sectional view of the portion of the cummerbund of FIG. 2.

Referring to FIGS. 2 and 3, in some implementations, the first end 2*a* of the cummerbund 2 terminates into a connector 5. The first end 3*a* of the pull cord 3 attaches to the connector 5 at the first end 2*a* of the cummerbund 2.

Figure 4:
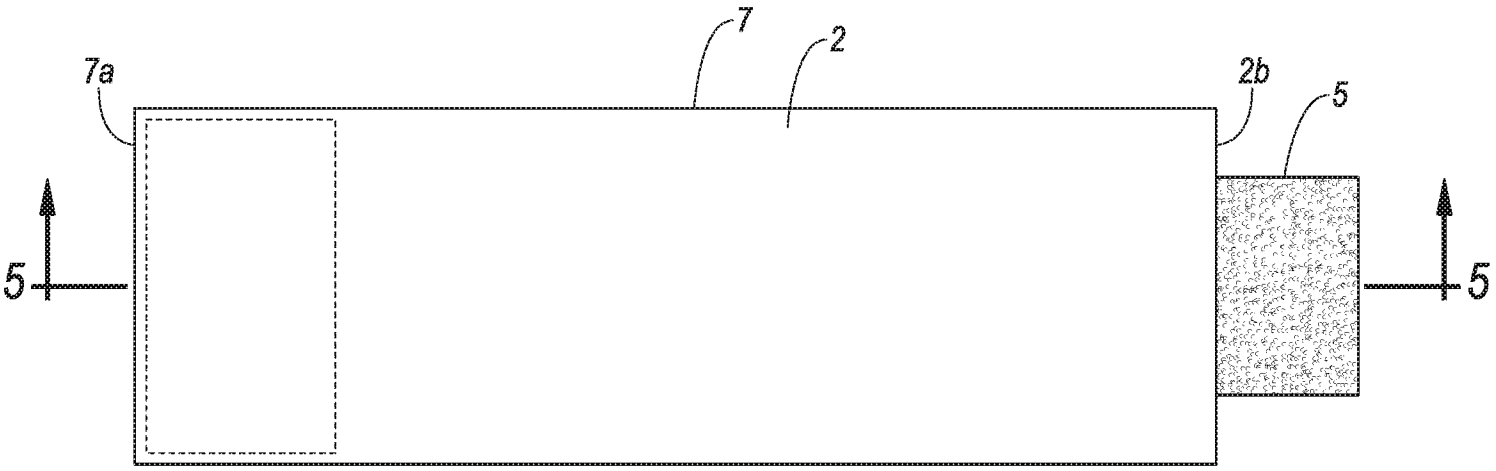
FIG. 4 is a plan view of a second portion of the cummerbund of FIGS. 1A and 1B.
Figure 5:
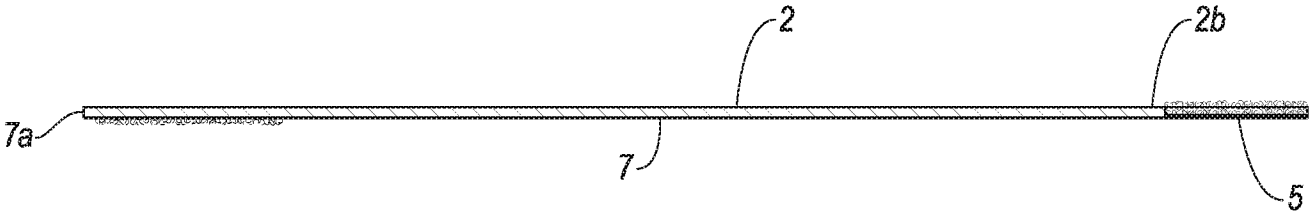
FIG. 5 is a sectional view of the portion of the cummerbund of FIG. 4.

Referring to FIGS. 4 and 5, in some implementations, the second end 2*b* of the cummerbund 2 also terminates into a connector 5. The connector 5 at the second end 2*b* of the cummerbund 2 opposes the connector 5 at the first end 2*a* of the cummerbund 2, with one of these connectors 5 including a hook portion of a hook and loop fastener and the other of these connectors 5 including a loop portion of a hook and loop fastener.

Figure 6:
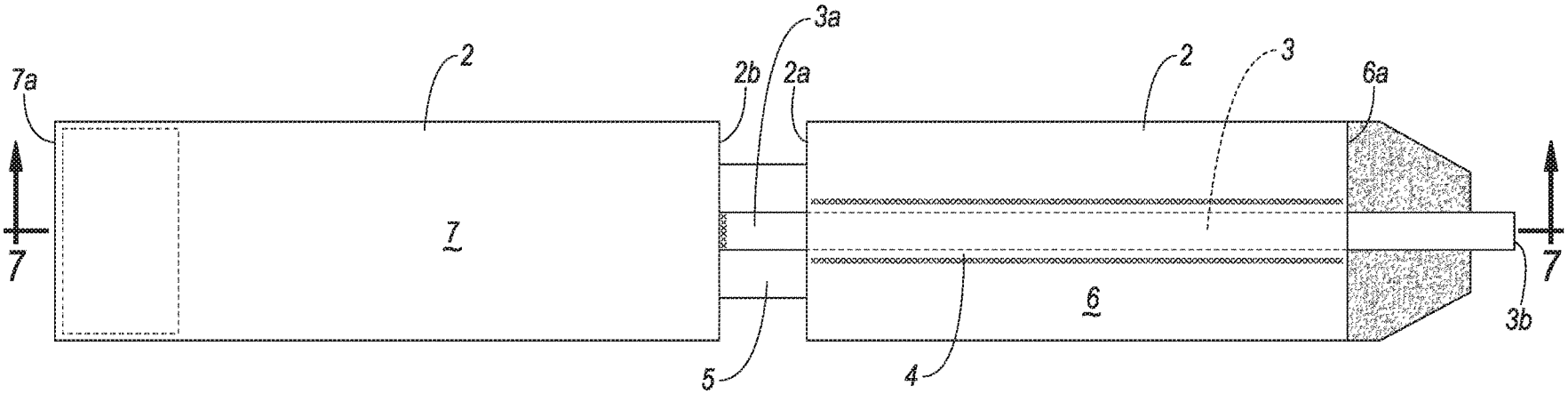
FIG. 6 is a plan view of the cummerbund of FIGS. 1A and 1B.
Figure 7:
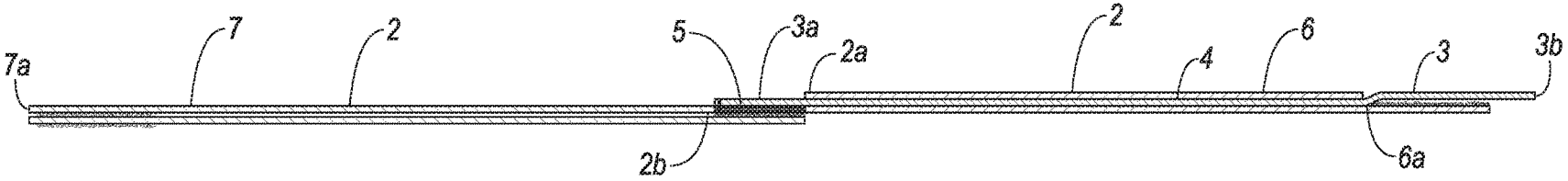
FIG. 7 is a sectional view of the cummerbund of FIG. 6.

Referring to FIGS. 6 and 7, in some implementation, the first half 6 of the cummerbund 2 connects to the second half 7 of the cummerbund 2 when the opposing connectors 5 are fastened.

Referring to FIGS. 2-7, in some implementations, the two-piece design of the cummerbund 2 creates a front end 6*a* of the first half 6 of the cummerbund 2 and a front end 7*a* of the second half 7 of the cummerbund 2.

Figure 8A:
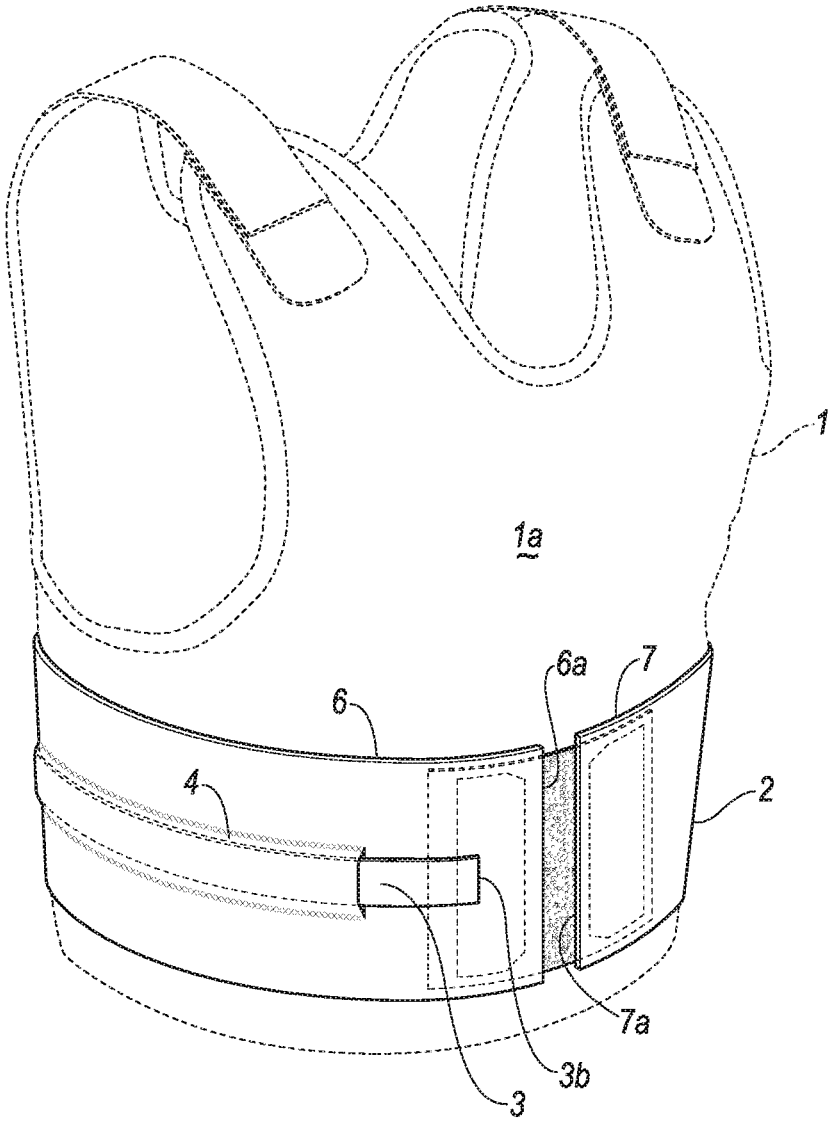
FIG. 8A is an isometric view of the front portion of a vest including a cummerbund that utilizes another exemplary implementation of the quick release fastening system. The front portion of the vest of FIG. 8A includes a connector to which both halves of the cummerbund connect.
Figure 8B:
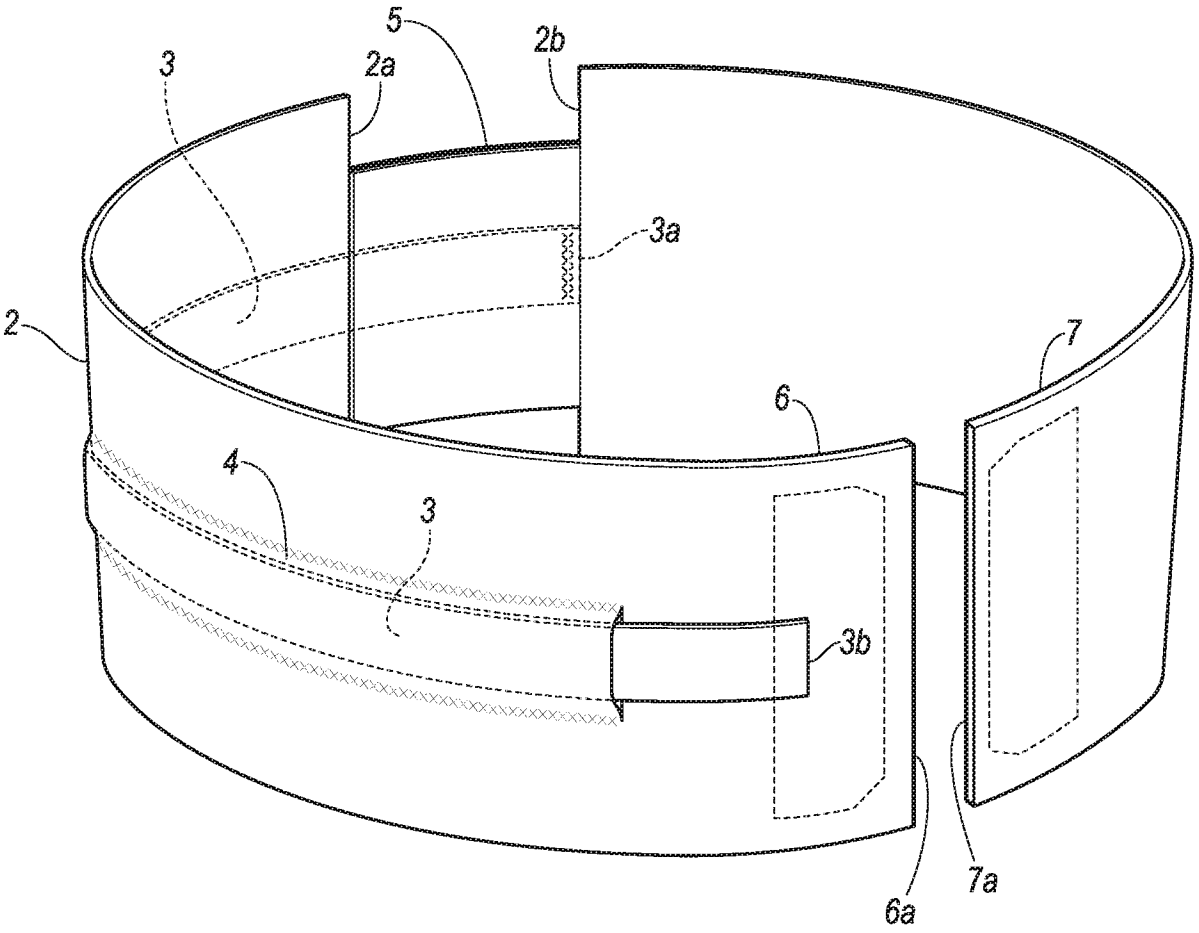
FIG. 8B is an isometric view of the cummerbund of FIG. 8A.

Referring to FIGS. 8A and 8B, in some implementations, the front end 6*a* of the first half 6 of the cummerbund 2 does not fasten to the front end 7*a* of the second half 7 of the cummerbund 2. Instead, a connector field, comprising either a hook portion or a loop portion of a hook and loop fastener, is disposed at the lower end of the front portion 1*a* of the vest 1. Both the front end 6*a* of the first half 6 of the cummerbund 2 and the front end 7*a* of the second half 7 of the cummerbund 2 include either a hook portion or a loop portion of a hook and loop fastener, which engages the connector field disposed on the front portion 1*a* of the vest 1.

Other than FIGS. 8A and 8B, all of the figures that include a cummerbund 2 with a two-piece design show a front end 6*a* of the first half 6 of the cummerbund 2, which fastens to a front end 7*a* of the second half 7 of the cummerbund 2. However, all implementations of the quick release fastening system shown in the figures are also compatible with a cummerbund 2 design in which both the first end 6*a* of the first half 6 of the cummerbund 2 and the first end 7*a* of the second half 7 of the cummerbund 2 fasten directly to a connector disposed on the front portion 1*a* of the vest 1.

Figure 9A:
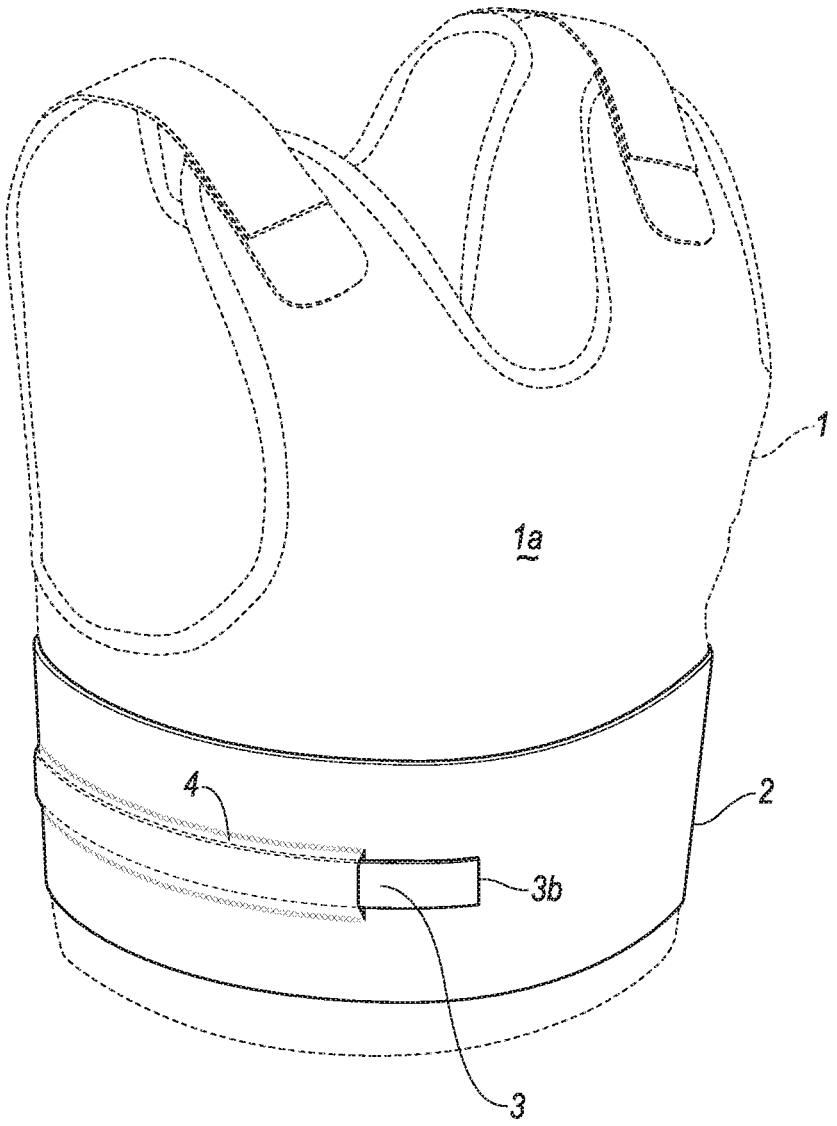
FIG. 9A is an isometric view of the front portion of a wearable article such as a vest including a cummerbund that utilizes another exemplary implementation of the quick release fastening system. The cummerbund of FIG. 9A has a one-piece design.
Figure 9B:
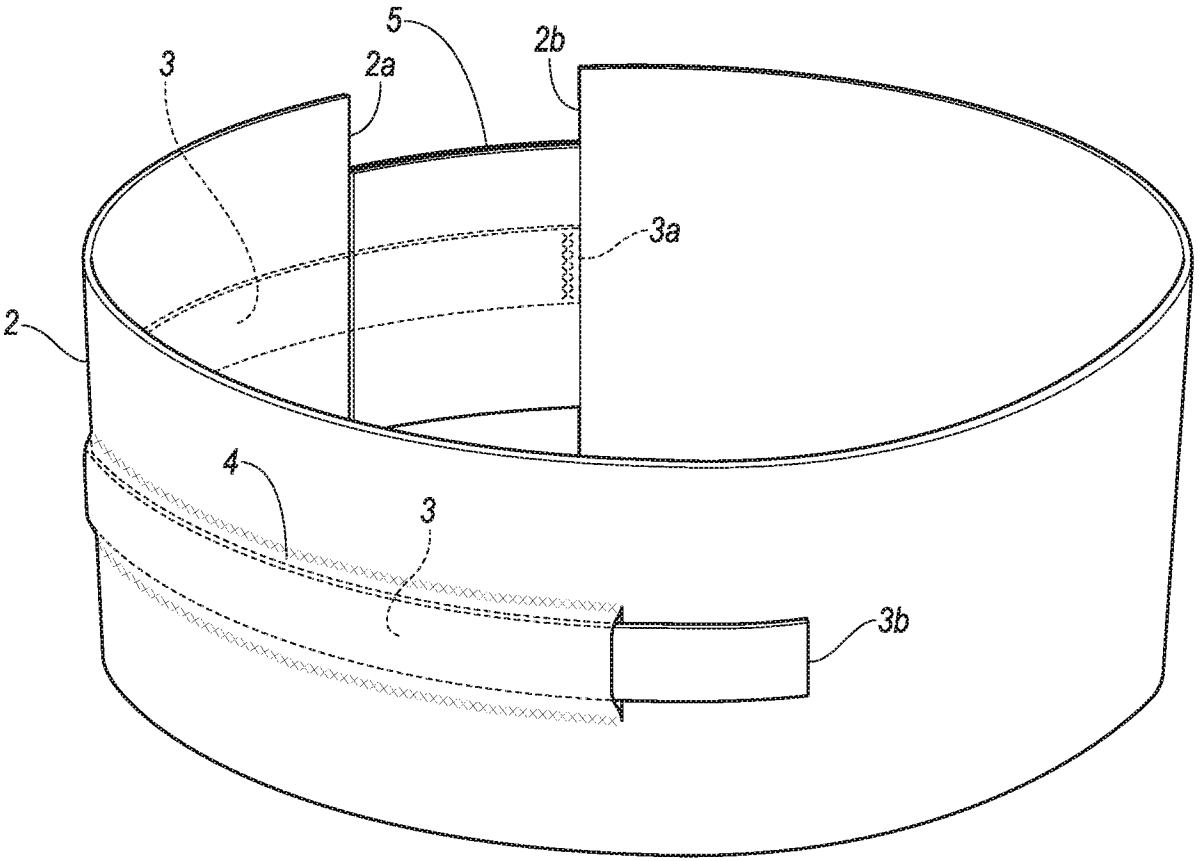
FIG. 9B is an isometric view of the wearable article of FIG. 9A.

Referring to FIGS. 9A and 9B, in some implementations, the cummerbund 2 has a one-piece design, with no fastener at the front portion 1*a* of the vest 1. This one-piece cummerbund 2 utilizes the quick release fastening system to fasten the first end 2*a* of the cummerbund 2 to the second end 2*b* of the cummerbund 2 with the connector 5.

Other than FIGS. 9A and 9B, all of the figures show a cummerbund 2 having a two-piece design. However, all implementations of the quick release fastening system shown in the figures are also compatible with a cummerbund 2 having a one-piece design.

The cummerbund 2, regardless of whether it is of a one-piece design or a two-piece design, may be affixed to the front portion 1*a* of the vest 1, fastened to the front portion 1*a* of the vest 1 and capable of release, or unattached to the front portion 1*a* of the vest 1.

Figure 10:
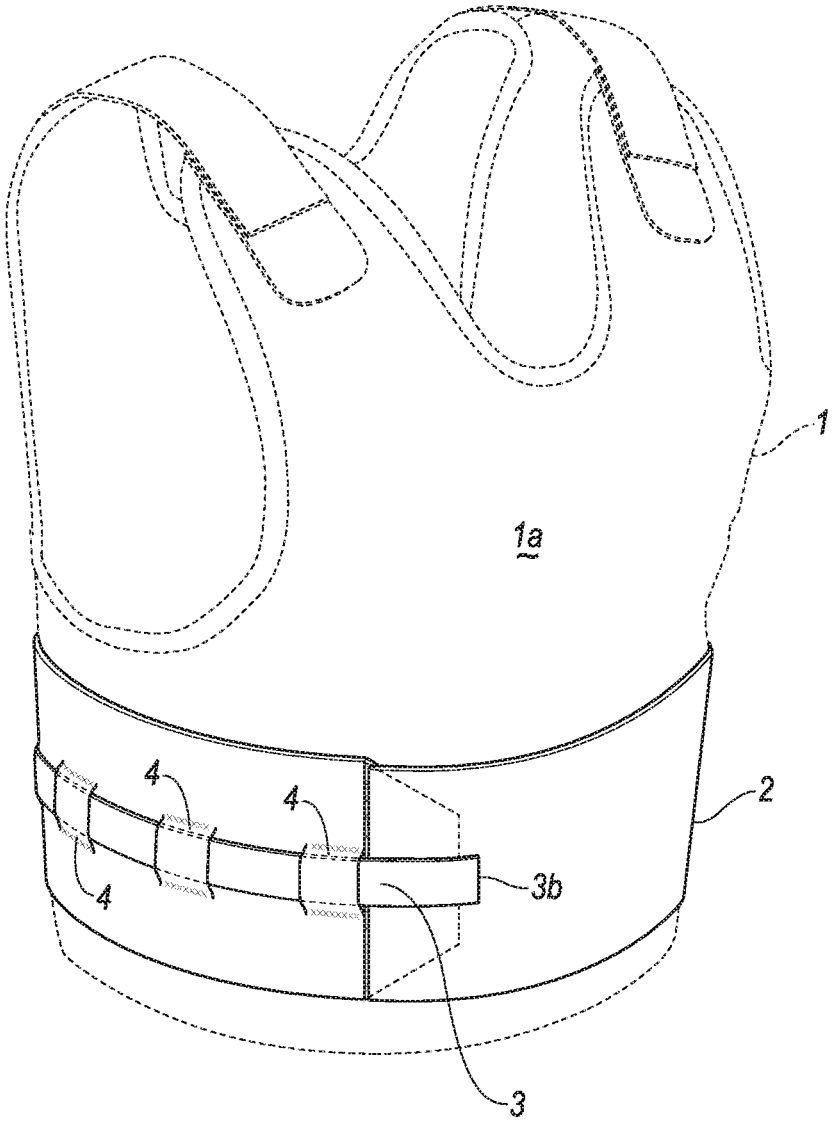
FIG. 10 is an isometric view of the front portion of a wearable article such as a vest including a cummerbund that utilizes another exemplary implementation of the quick release fastening system. The implementation of FIG. 10 illustrates an alternative type of conduit in which the pull cord resides.

Referring to FIG. 10, in some implementations, the conduit 4 has a non-continuous design.

Other than FIG. 10, all of the figures show a conduit 2 having a continuous design. However, all implementations of the quick release fastening system shown in the figures are also compatible with a conduit having a non-continuous design.

Figure 11A:
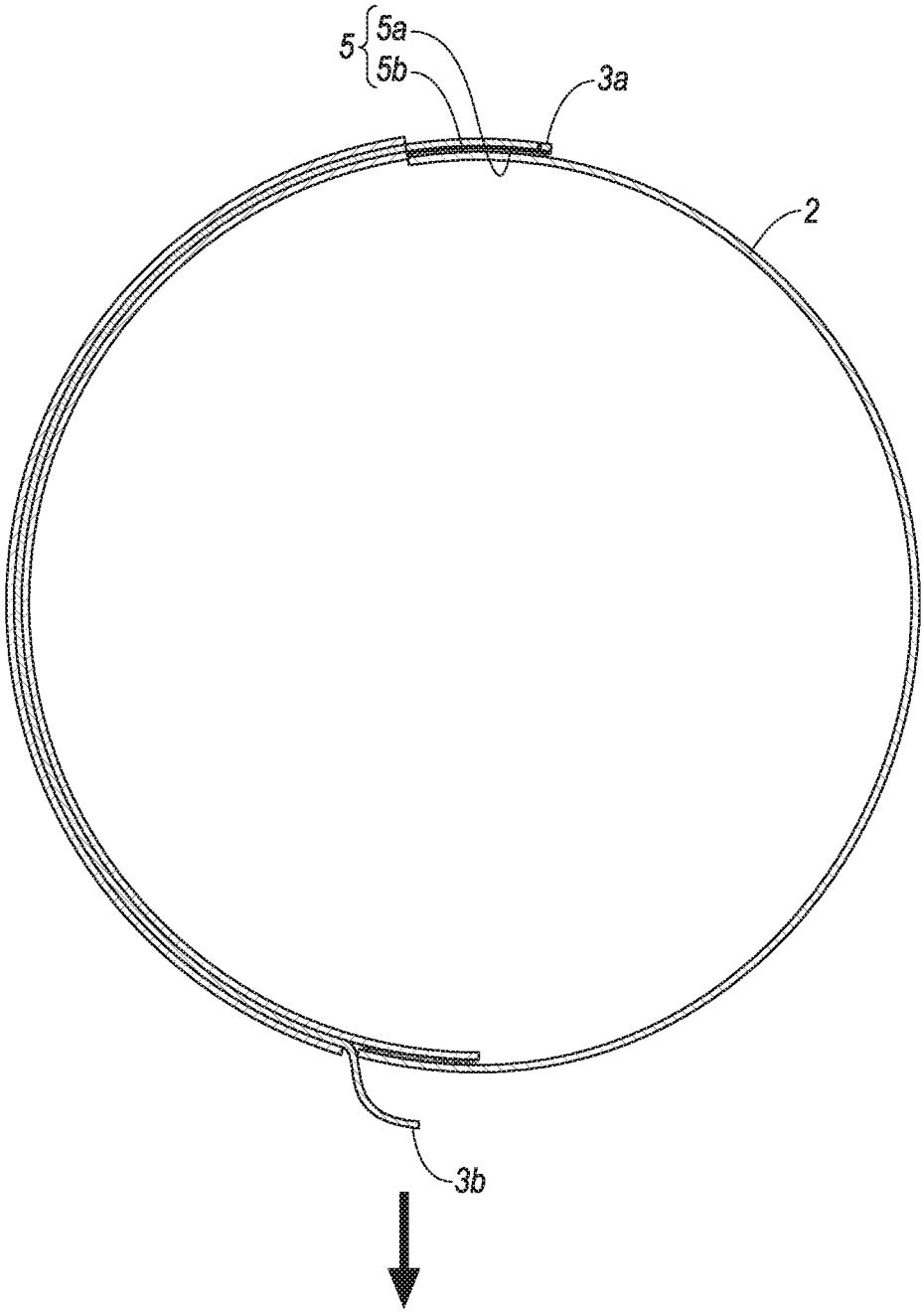
FIG. 11A is a top view of the cummerbund of FIGS. 1A and 1B.

Referring to FIG. 11A, in some implementations, the user may engage the quick release fastening system by a frontal pull of the second end 3*b* of the pull cord 3 for peeling a peelable portion 5*a* of the connector 5 from a fixed portion 5*b* of the connector.

Figure 11B:
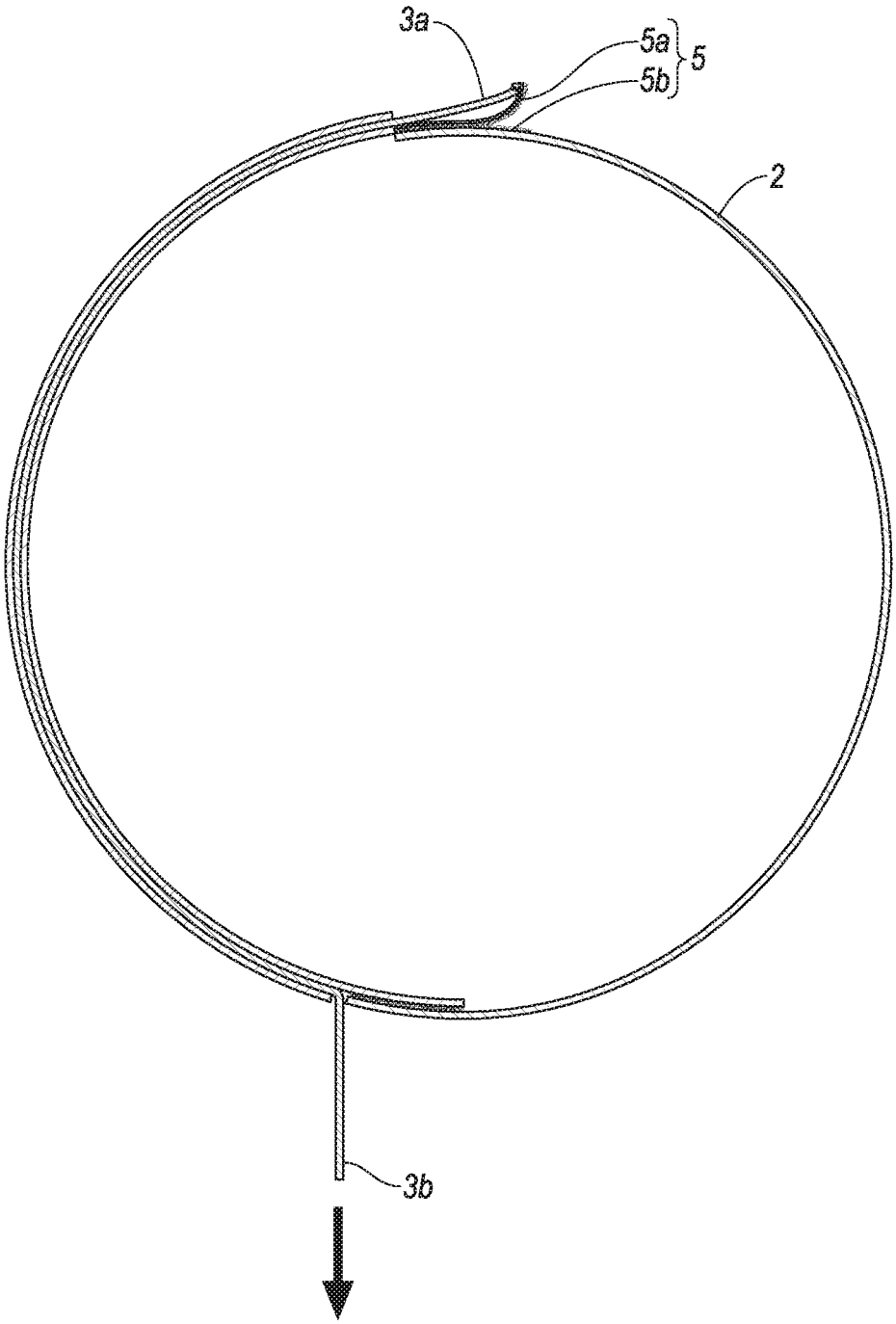
FIG. 11B is a top view of the cummerbund of FIGS. 1A and 1B.

Referring to FIG. 11B, in some implementations, engaging the quick release fastening system with a frontal pull of the second end 3*b* of the pull cord 3 results in the first end 3*a* of the pull cord 3 peeling the peelable portion 5*a* of the connector 5 from the fixed portion 5*b* of the connector 5 to disengage the hook and loop fastener.

Figure 11C:
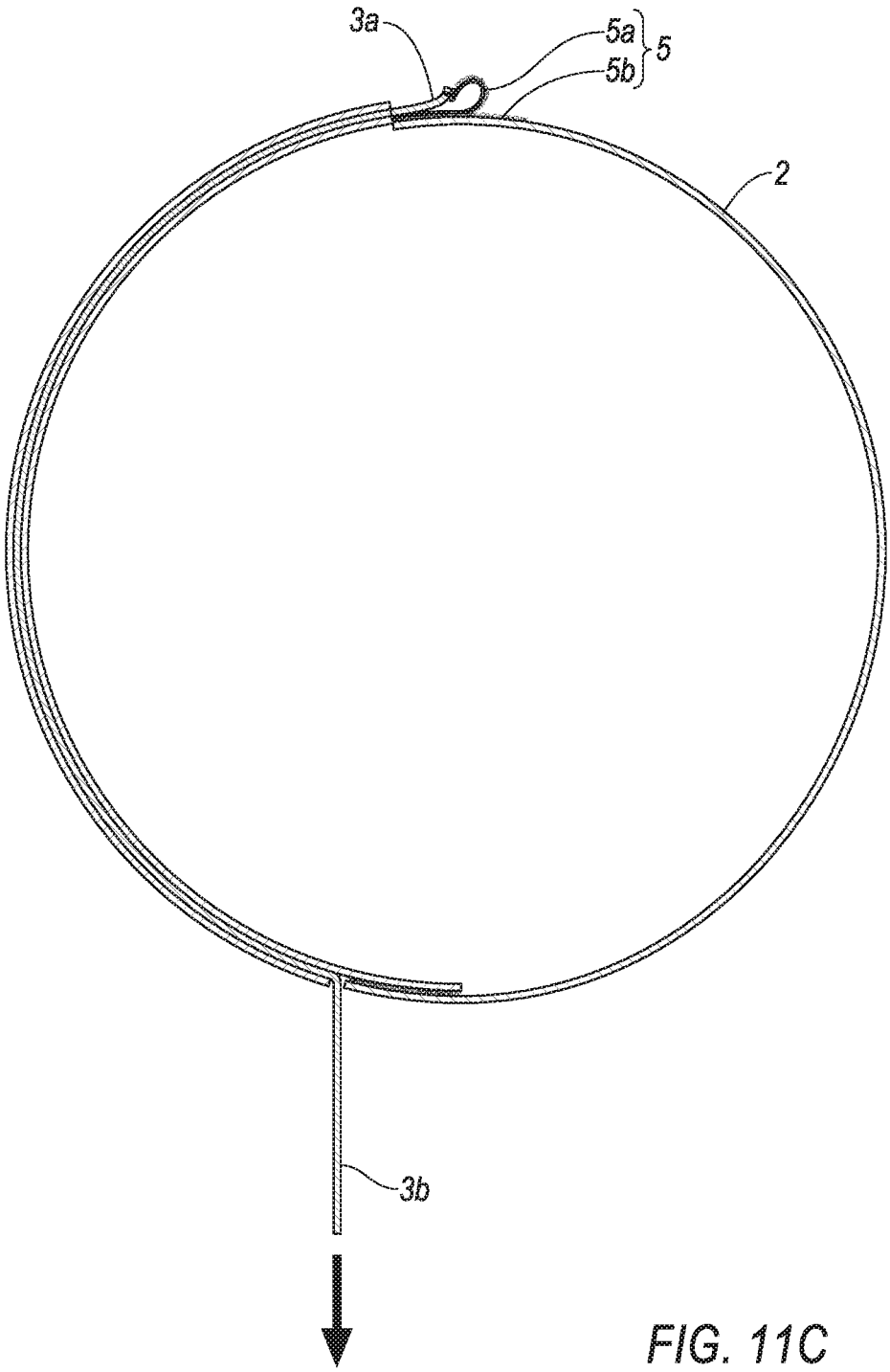
FIG. 11C is a top view of the cummerbund of FIGS. 1A and 1B.

Referring to FIG. 11C, in some implementations, as the quick release fastening system is continued to be engaged, the first end 3*a* of the pull cord 3 continues to peel back the peelable portion 6*a* of the connector 5 from the fixed portion 5*b* of the connector 5.

Figure 11D:
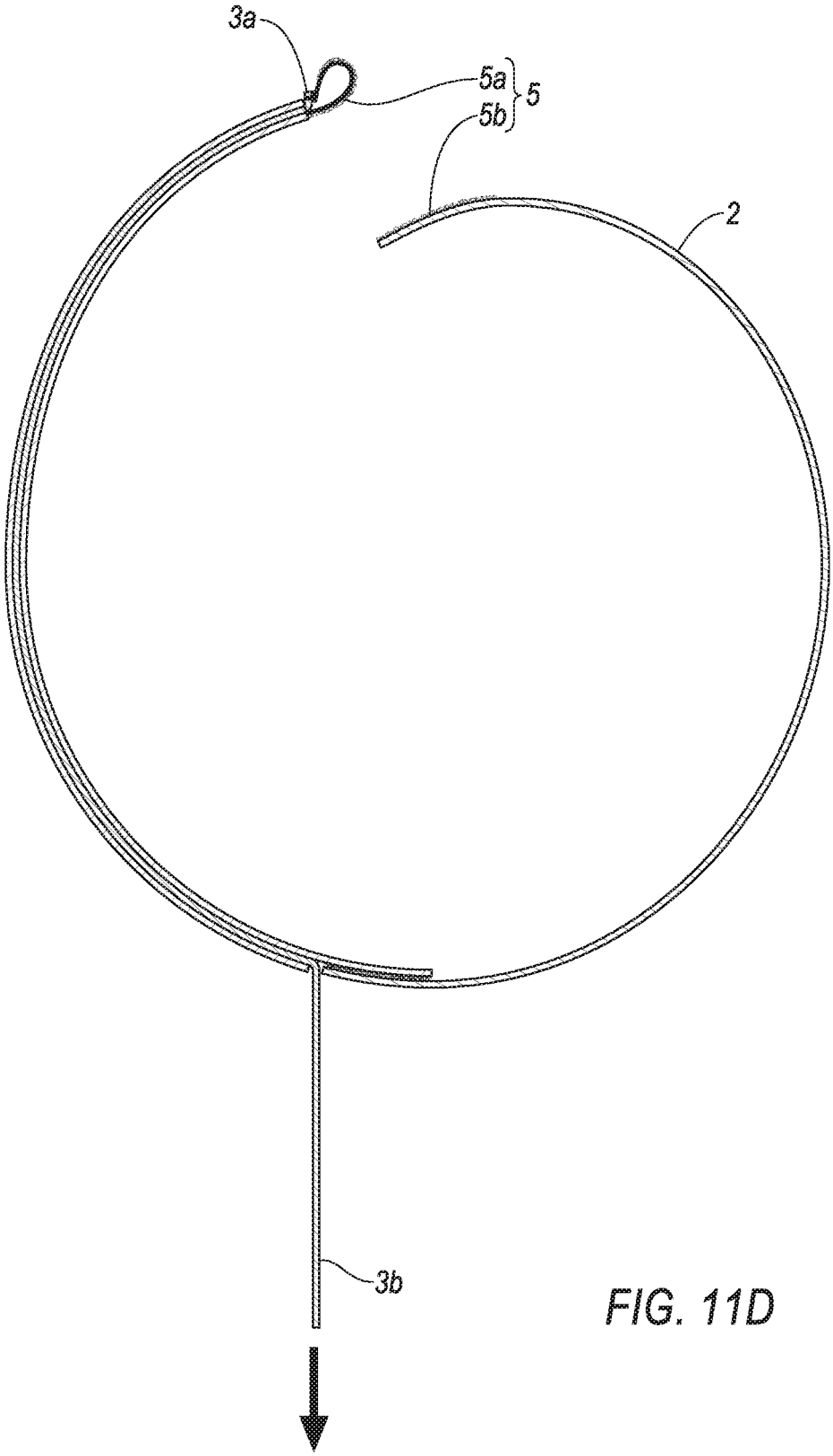
FIG. 11D is a top view of the cummerbund of FIGS. 1A and 1B.

Referring to FIG. 11D, in some implementation, when the quick release fastening system is fully engaged, the first end 3*a* of the pull cord 3 has receded to the opening of the conduit 4 and the peelable portion 5*a* of the connector 5 has been fully peeled from the fixed portion 5*b* of the connector 5, resulting in complete disengagement of the hook and loop fastener. When the fastener is completely disengaged, release has occurred and the first half 6 of the cummerbund 2 becomes disconnected from the second half 7 of the cummerbund.

Figure 12A:
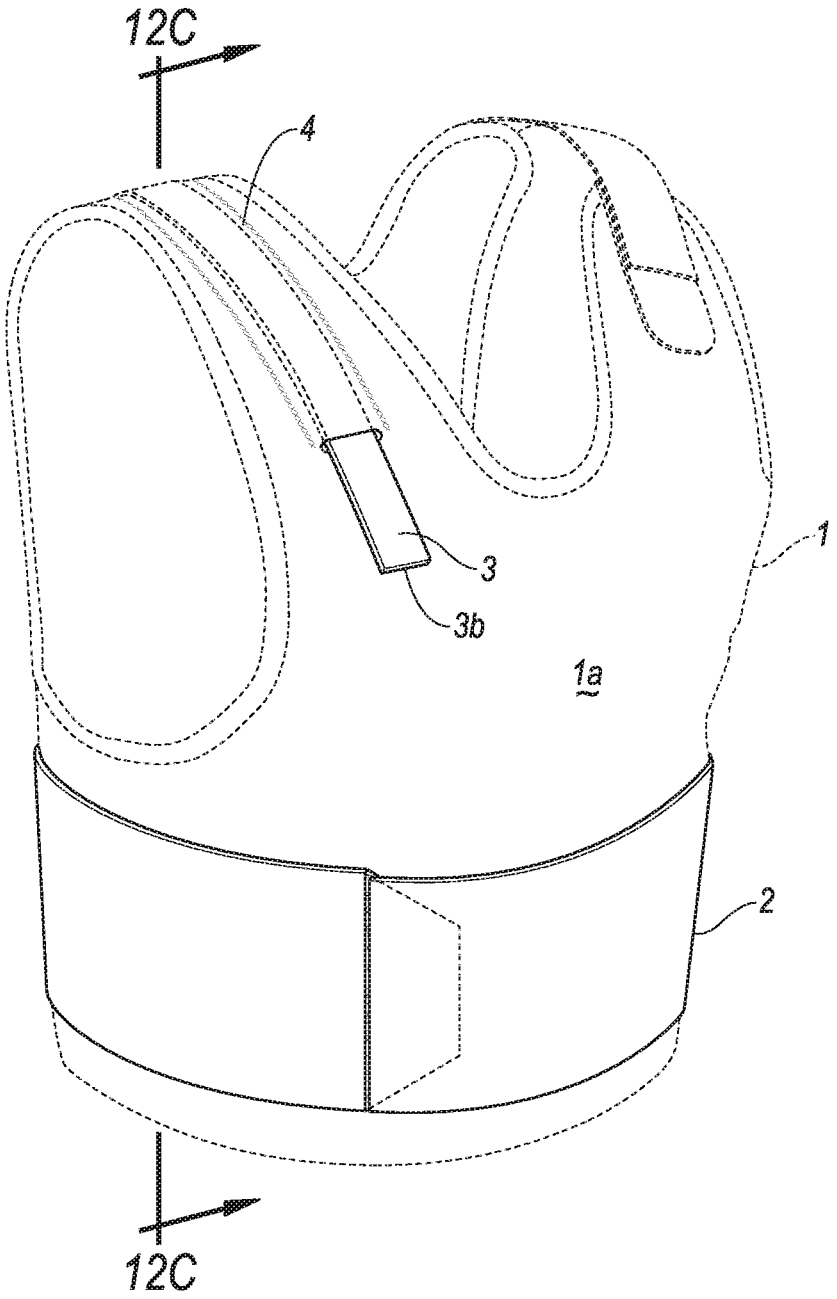
FIG. 12A is an isometric view of the front portion of a vest including a cummerbund that utilizes another exemplary implementation of the quick release fastening system.
Figure 12B:
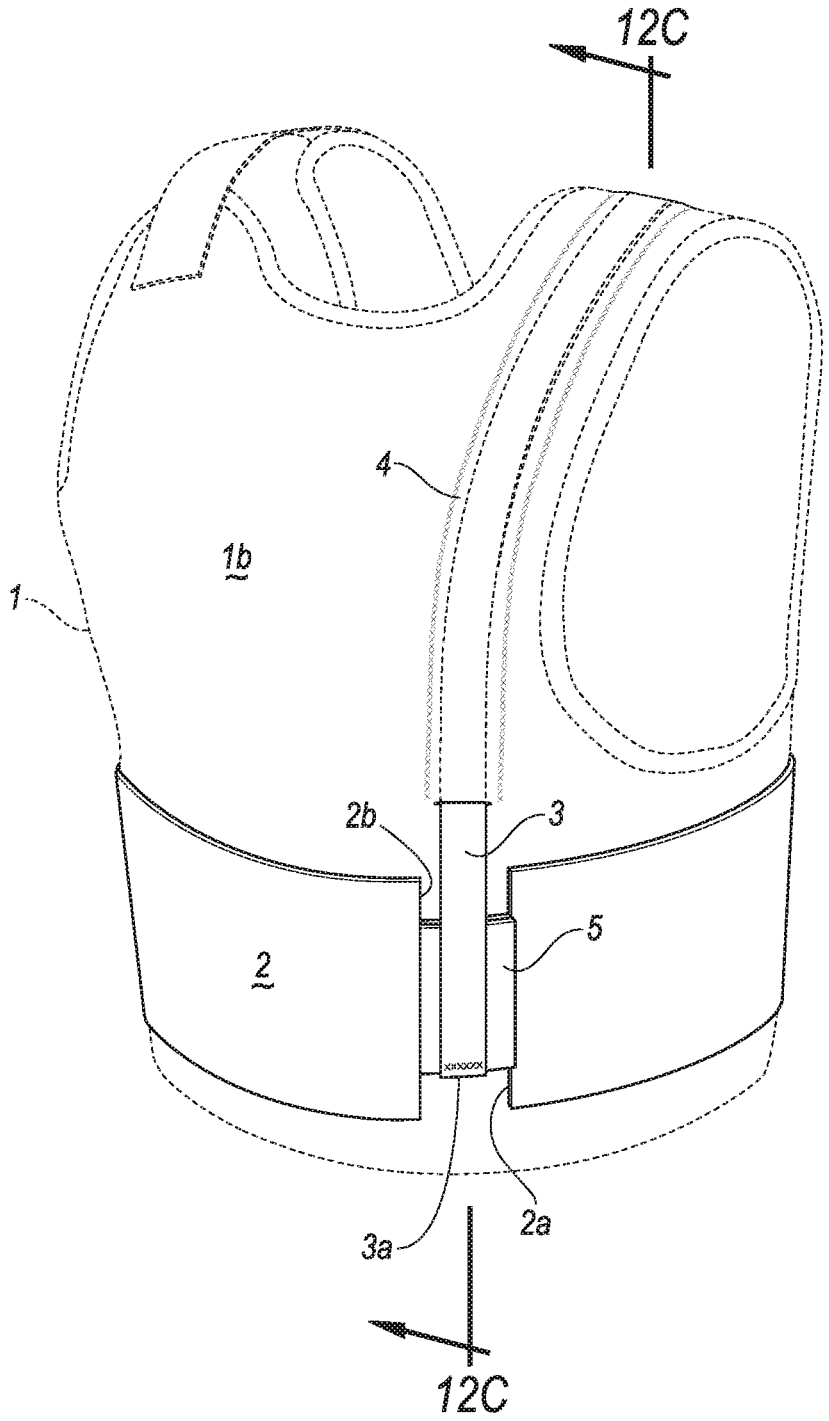
FIG. 12B is an isometric view of the back portion of a vest including a cummerbund that utilizes another exemplary implementation of the quick release fastening system.
Figure 12C:
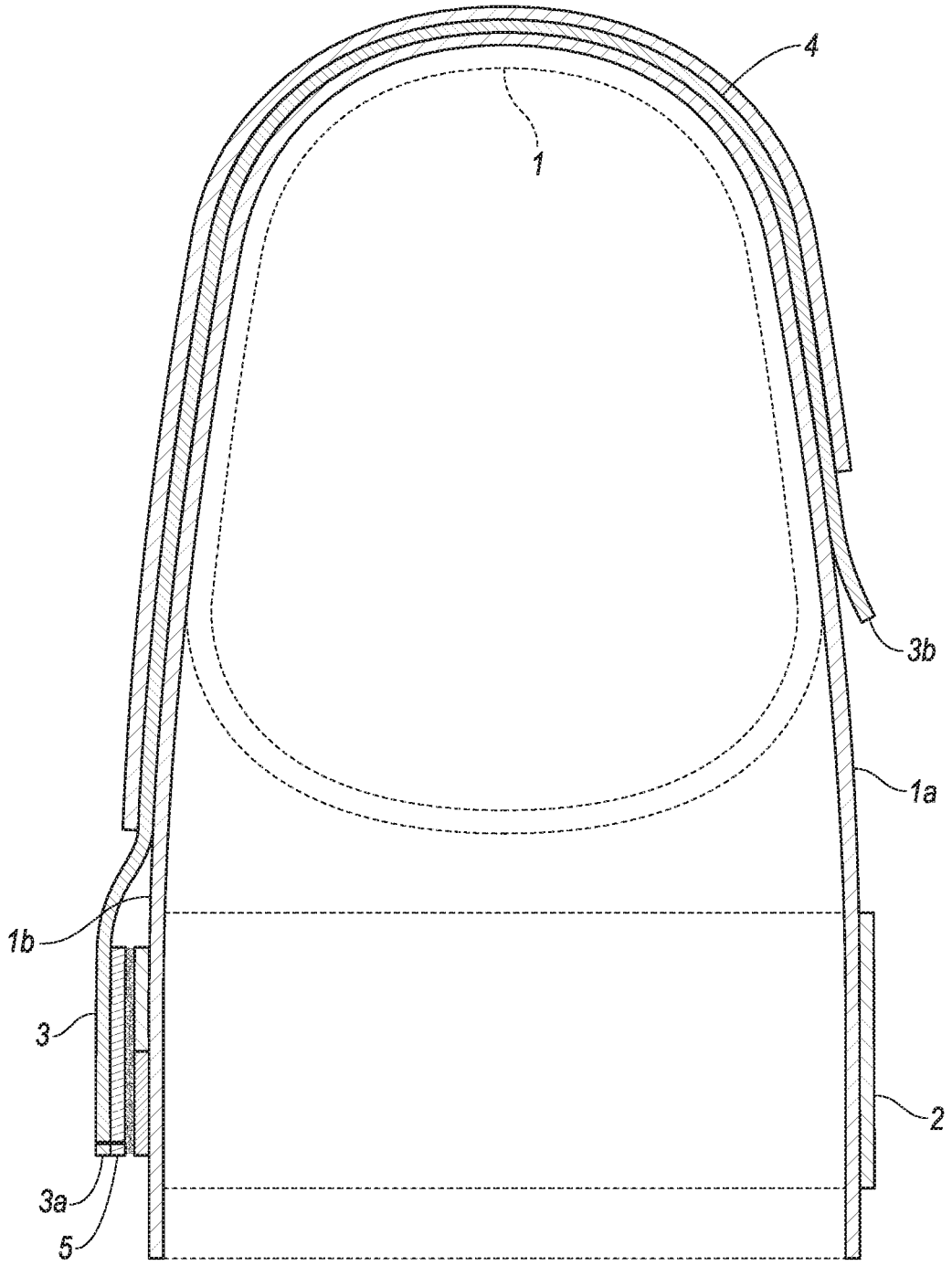
FIG. 12C is a sectional view of the vest of FIGS. 12A and 12B.

Referring to FIGS. 12A, 12B, and 12C, in some implementations, the conduit 4 in which the pull cord 3 partially resides is formed through the front portion 1*a* and the back portion 1*b* of the vest 1.

The second end 3*b* of the pull cord 3 may reside proximate to the front portion 1*a* of the vest 1. The user may engage the quick release mechanism of the fastening system with a frontal pull of the second end 3*b* of the pull cord 3. Engagement of the quick release mechanism causes the first end 3*a* of the pull cord 3 to peel the connector 5 at the back portion 1*b* of the vest The front portion 1*a* and the back portion 1*b* of the vest 1 may be attached at the shoulder of the vest 1 with a continuous connection or a strapped connection. In all implementations of the quick release fastening system, either type of connection at the shoulder of the vest 1 can be utilized without affecting the fastening system.

Figure 13A:
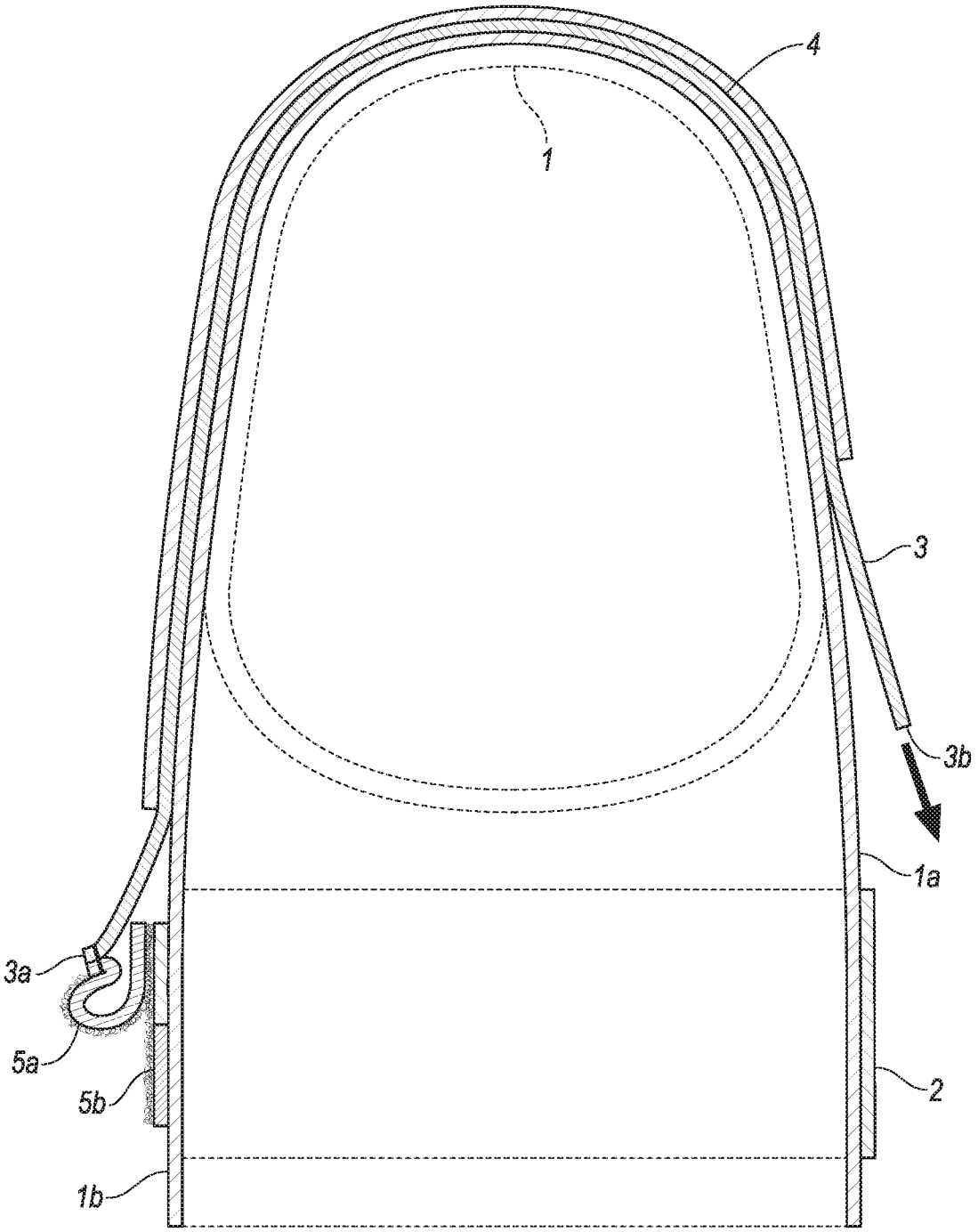
FIG. 13A is a sectional view of that vest of FIGS. 12A and 12B.

Referring to FIG. 13A, in some implementations, the user may engage the quick release mechanism by a frontal pull of the second end 3*b* of the pull cord 3. This frontal pull causes in the first end 3*a* of the pull cord 3 to vertically peel the pull tab portion 5*a* of the connector 5 to disengage the hook and loop fastener.

Figure 13B:
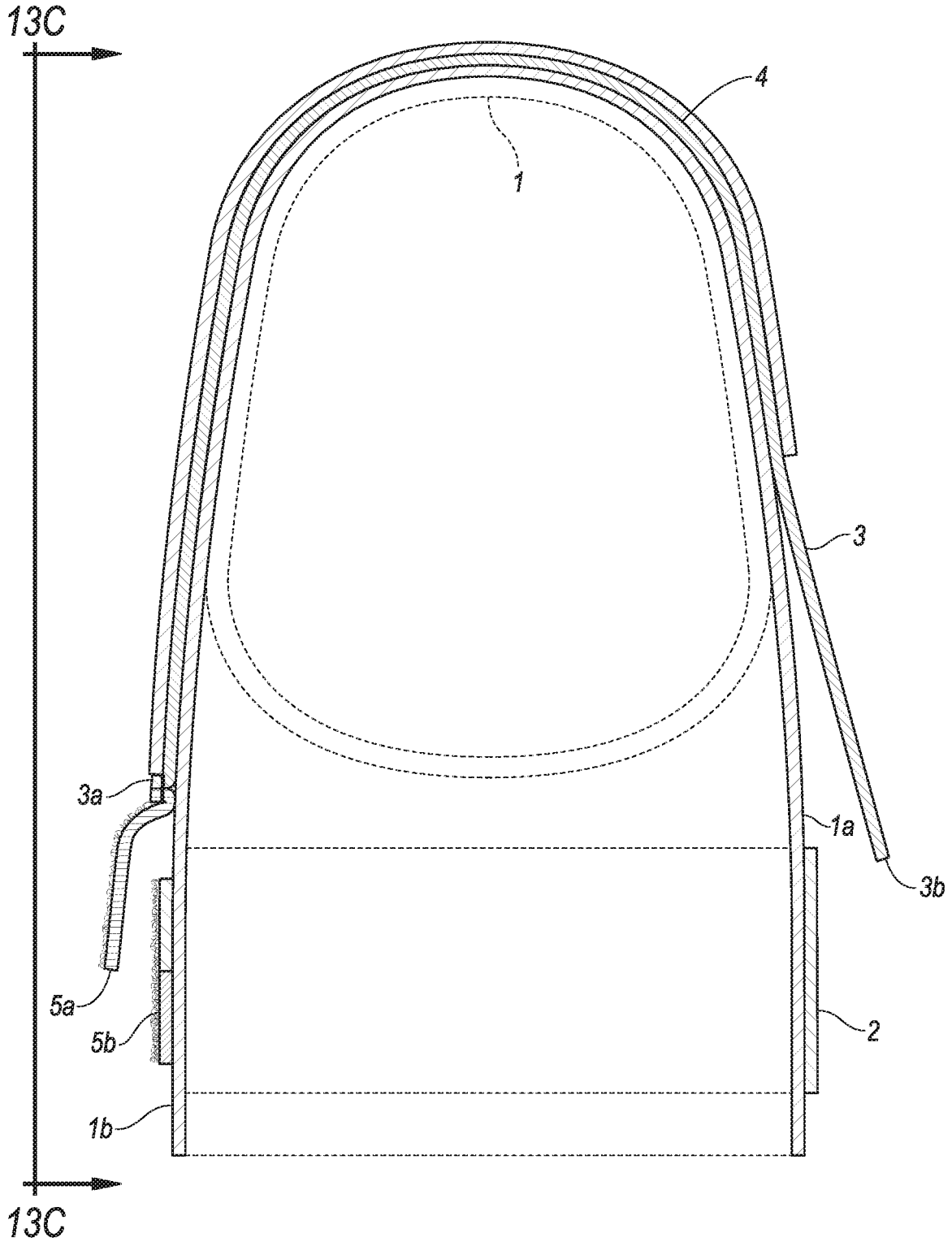
FIG. 13B is a sectional view of that vest of FIGS. 12A and 12B.

Referring to FIG. 13B, in some implementations, when the quick release mechanism is fully engaged, the first end 3*a* of the pull cord 3 has vertically receded to the opening of the conduit 4 and the connector 5 has been fully peeled. The quick release mechanism has fully disengaged the hook and loop fastener.

Figure 13C:
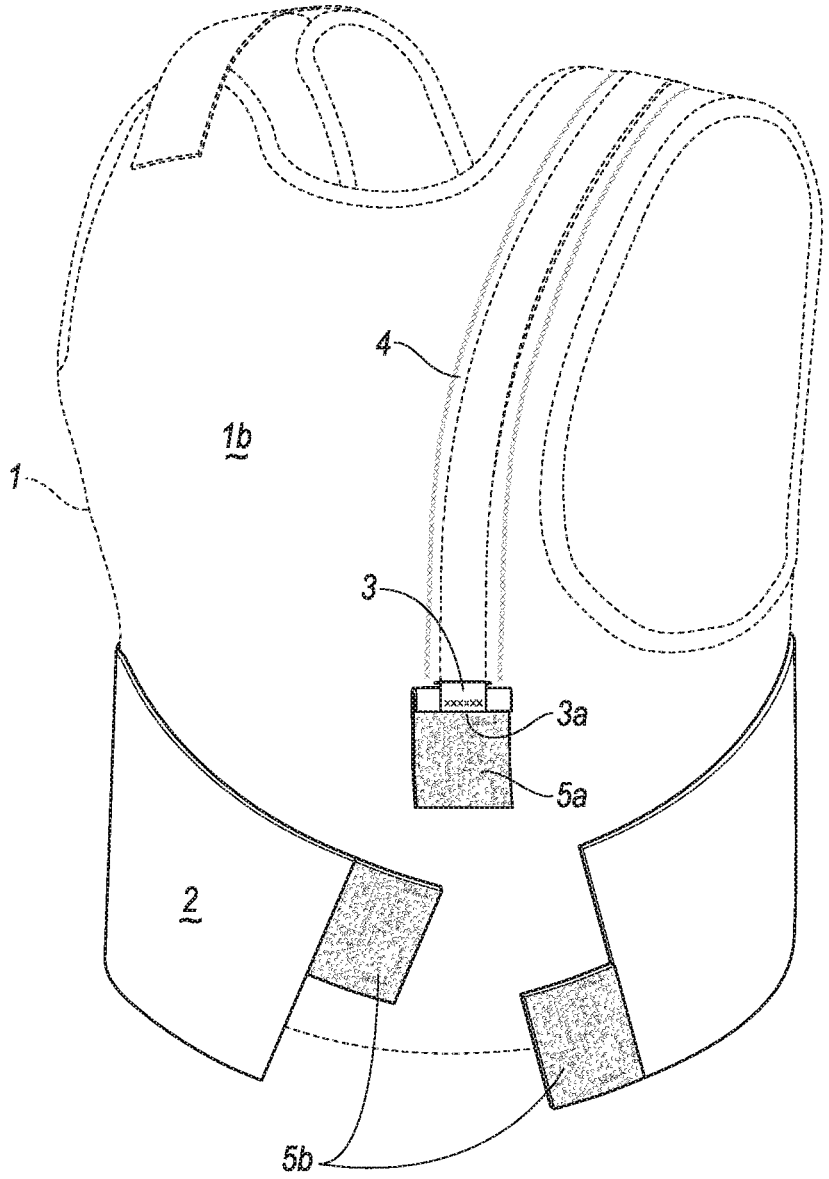
FIG. 13C is an isometric view of the back portion of the vest of FIGS. 12A and 12B.

Referring to FIG. 13C, in some implementations, when the quick release mechanism is fully engaged, the cummerbund 2 is completely disconnected at the back portion 1*b* of the vest 1.

The cummerbund portion 5*b* of the connector 5 consists of two segments. One segment is attached to the first end 2*a* of the cummerbund 2. The other segment is attached to the second end 2*b* of the cummerbund 2. When fully peeled, the pull tab portion 5*a* of the connector 5 is completely disengaged from both segments of the cummerbund portion 5*b* of the connector 5.

The two segments of the cummerbund portion 5*b* of the connector 5 can be divided vertically, horizontally, or at any angle allowing for the pull tab portion 5*a* of the connector 5 to securely fasten to both segments of the cummerbund portion 5*b* of the connector 5. The implementation in FIG. 13C illustrates a horizontal division between the segments. The implementation in FIG. 15D illustrates a vertical division between the segments.

Figure 14A:
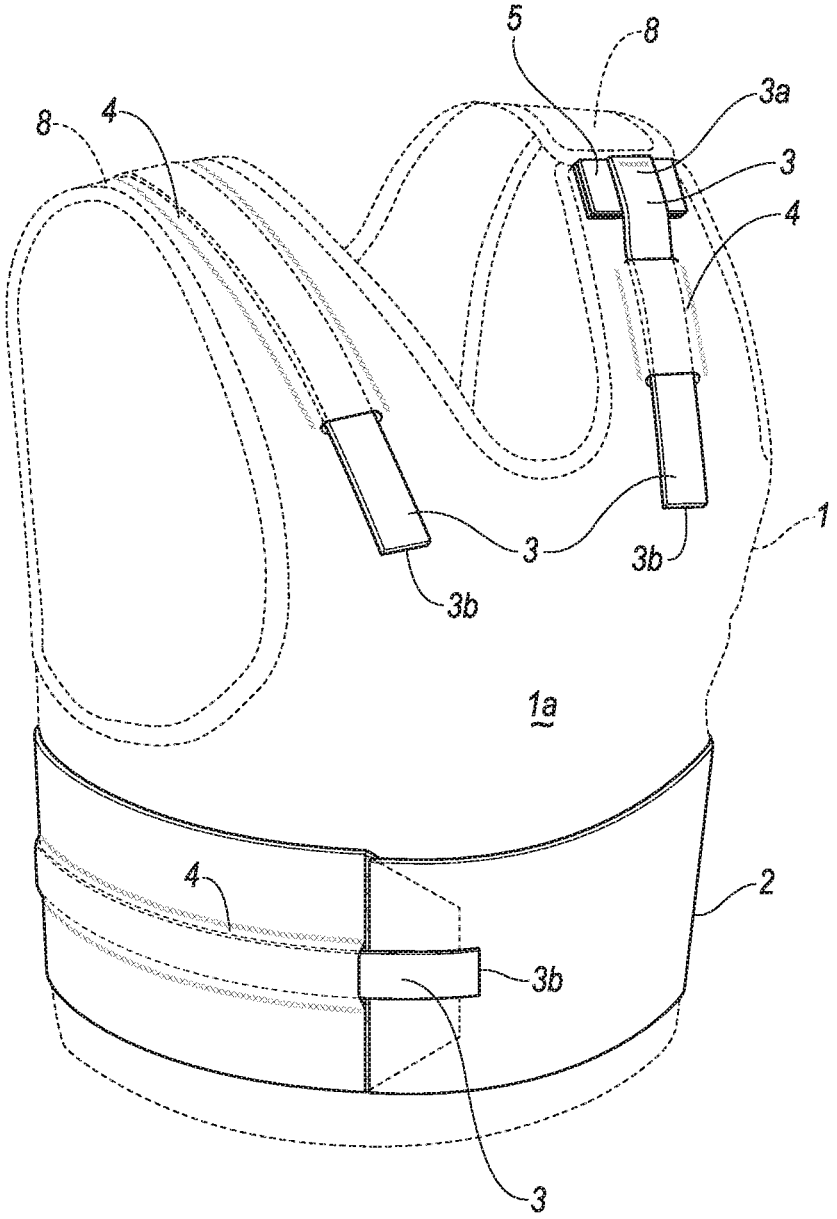
FIG. 14A is an isometric view of the front portion of a vest that utilizes three exemplary implementations of the quick release fastening system. One exemplary implementation is utilized for fastening and releasing the cummerbund, and two exemplary implementations are utilized for fastening and releasing the front portion the vest to the back portion of the vest.
Figure 14B:
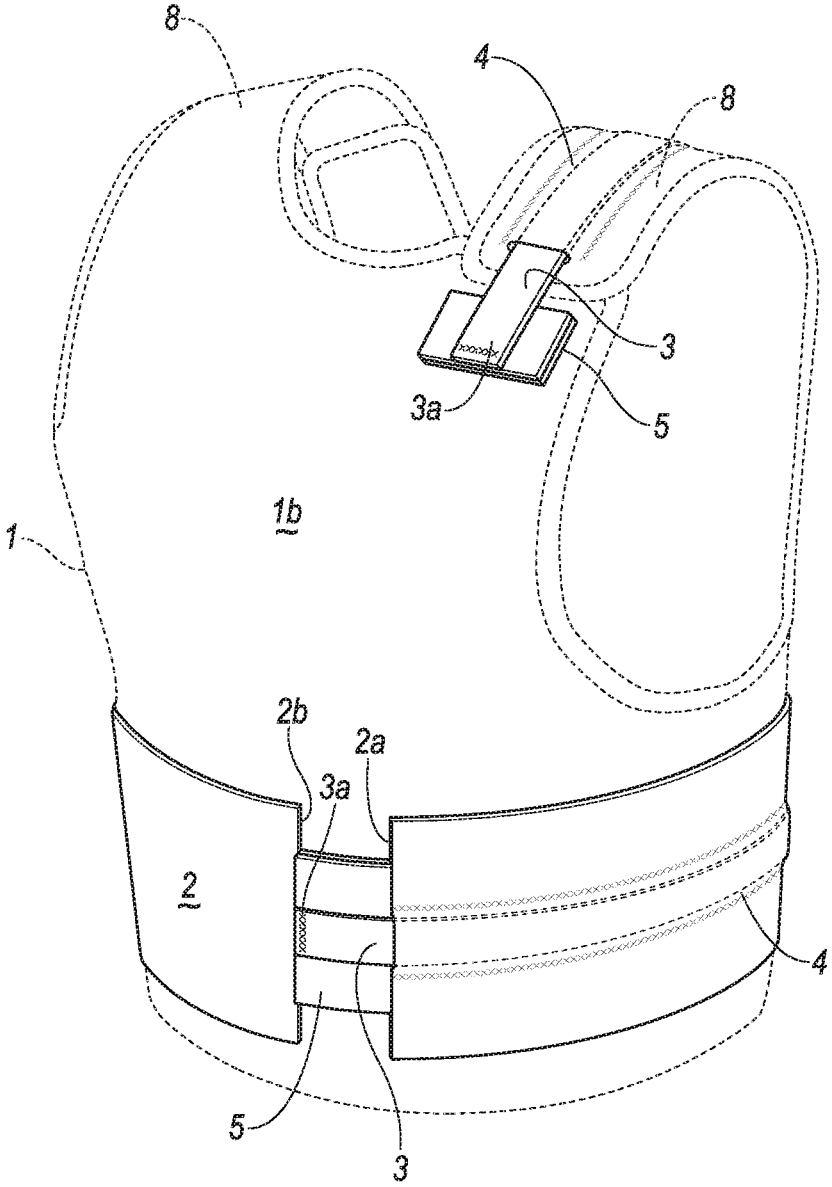
FIG. 14B is an isometric view of the back portion of a vest that utilizes three exemplary implementations of the quick release fastening system. One exemplary implementation is utilized for fastening and releasing the cummerbund, and two exemplary implementations are utilized for fastening and releasing the front portion the vest to the back portion of the vest.

Referring to FIGS. 14A and 14B, in some implementations, the quick release fastening system is utilized to fasten and release the front portion 1*a* of the vest 1 and the back portion 1*b* of the vest 1. The quick release fastening system can be utilized at either one shoulder strap 8 or both shoulder straps 8. When the system is utilized to connect the front portion 1*a* of the vest 1 to the back portion 1*b* of the vest 1, an additional quick release fastening system can optionally also be utilized on the cummerbund 2.

Each shoulder strap 8 has one end that is attached to either the front portion 1*a* of the vest 1 or the back portion 1*b* of the vest 1. The other end of each shoulder strap terminates into a connector 5, which corresponds to an opposing connector 5. The opposing connector 5 is affixed to either the front portion 1*a* of the vest 1 or the back portion 1*b* of the vest 1.

The attachment of the shoulder strap 8 to either the front portion 1*a* of the vest or the back portion 1*b* of the vest can be accomplished in a number of ways. The shoulder strap 8 can be a separate component of the vest 1 that is permanently affixed or securely fastened to either the front portion 1*a* of the vest 1 or the back portion 1*b* of the vest 1. The shoulder strap 8 can also be a continuation of either the front portion 1*a* of the vest 1 or the back portion 1*b* of the vest 1.

A conduit 4 in which a pull cord 3 partially resides is formed through each shoulder strap 8 of the vest 1. A pull cord 3, with an opposing first end 3*a* and second end 3*b*, resides partially within the conduit 4. The first end 3*a* of the pull cord 3 is affixed to the connector 5. The second end 3*b* of the pull cord 3 extends from the conduit 4 to reside at the front portion 1*b* of the vest 1.

The second end 3*b* of each pull cord 3 resides proximate to the front portion 1*a* of the tactical vest 1. The user may engage the quick release mechanism with a frontal pull of the second end 3*b* of each pull cord 3. Engagement of the quick release mechanism causes the first end 3*a* of each pull cord 3 to disengage the connector 5 between the shoulder strap 8 and the back portion 1*b* of the tactical vest 1.

Figure 15A:
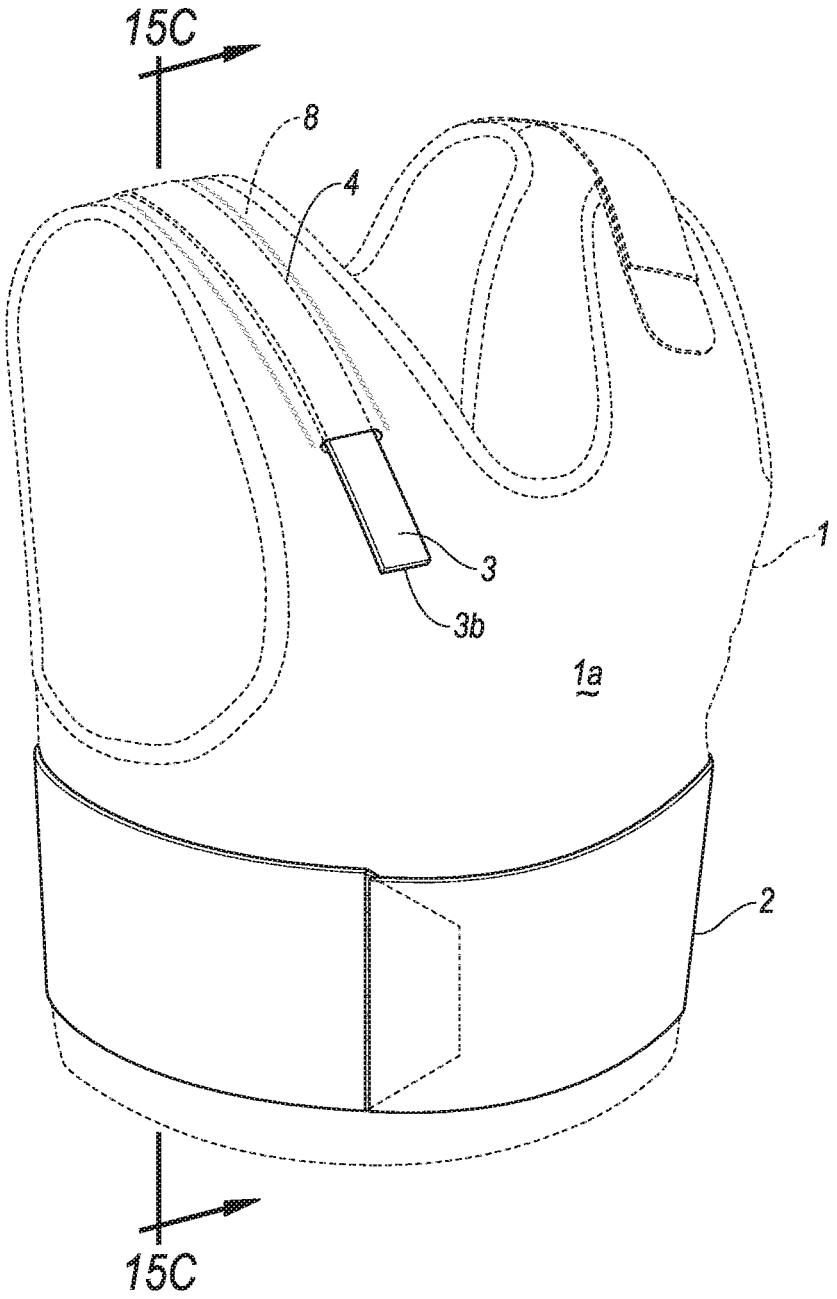
FIG. 15A is an isometric view of the front portion of a vest that utilizes an exemplary implementation of the quick release fastening system.
Figure 15B:
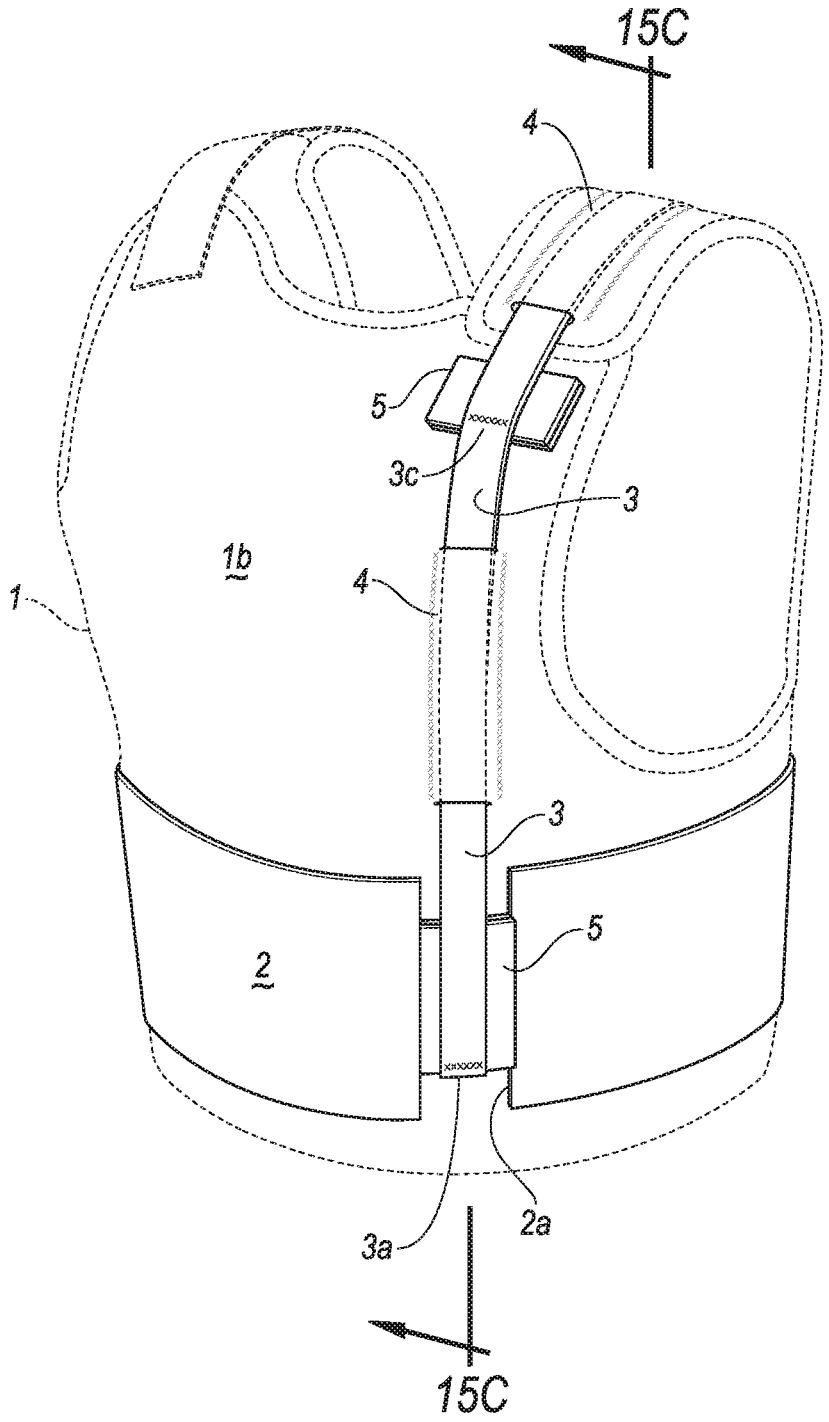
FIG. 15B is an isometric view of the back portion of a vest that utilizes an exemplary implementation of the quick release fastening system.
Figure 15C:
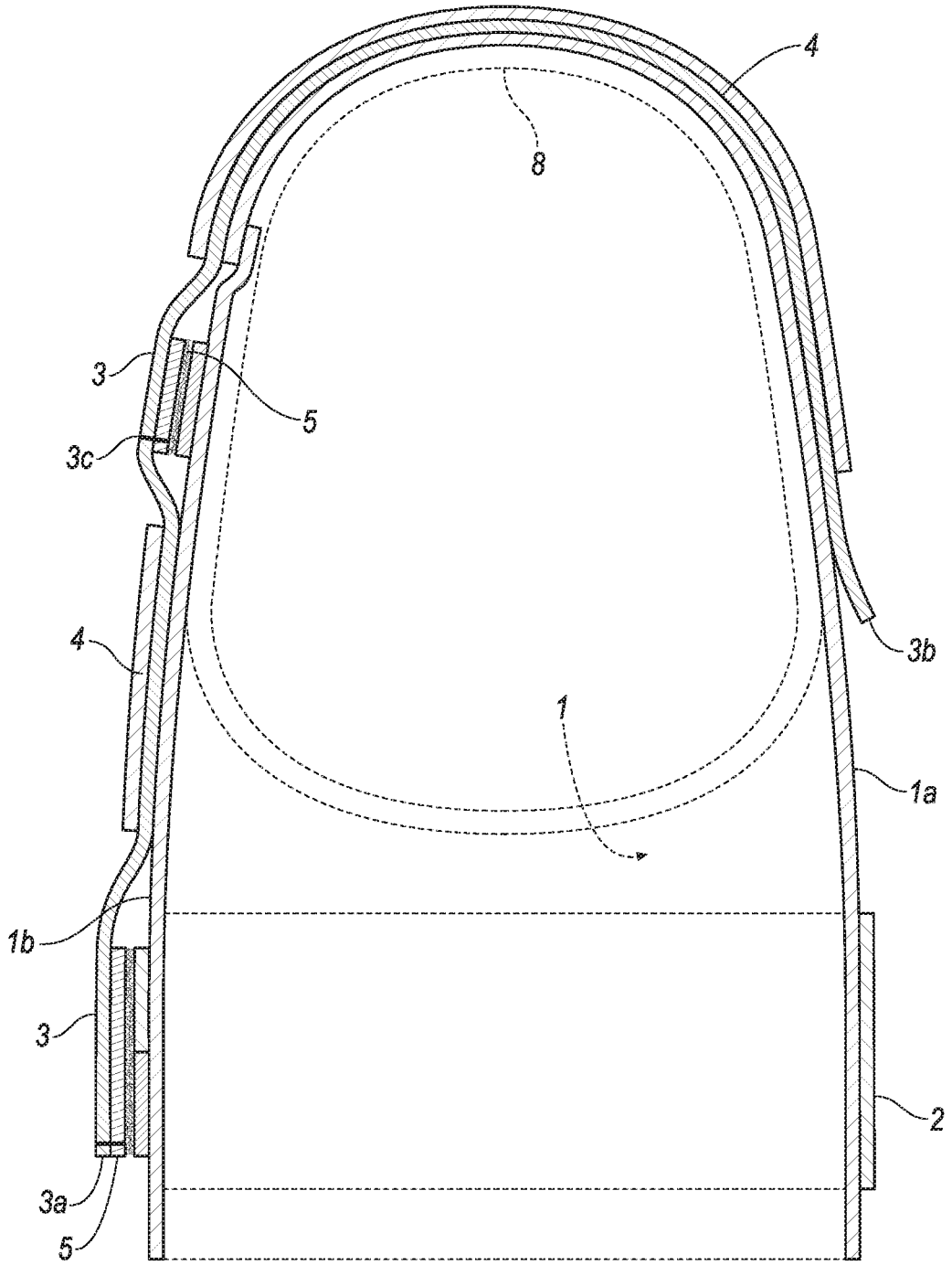
FIG. 15C is a sectional view of the vest of FIGS. 15A and 15B.
Figure 15D:
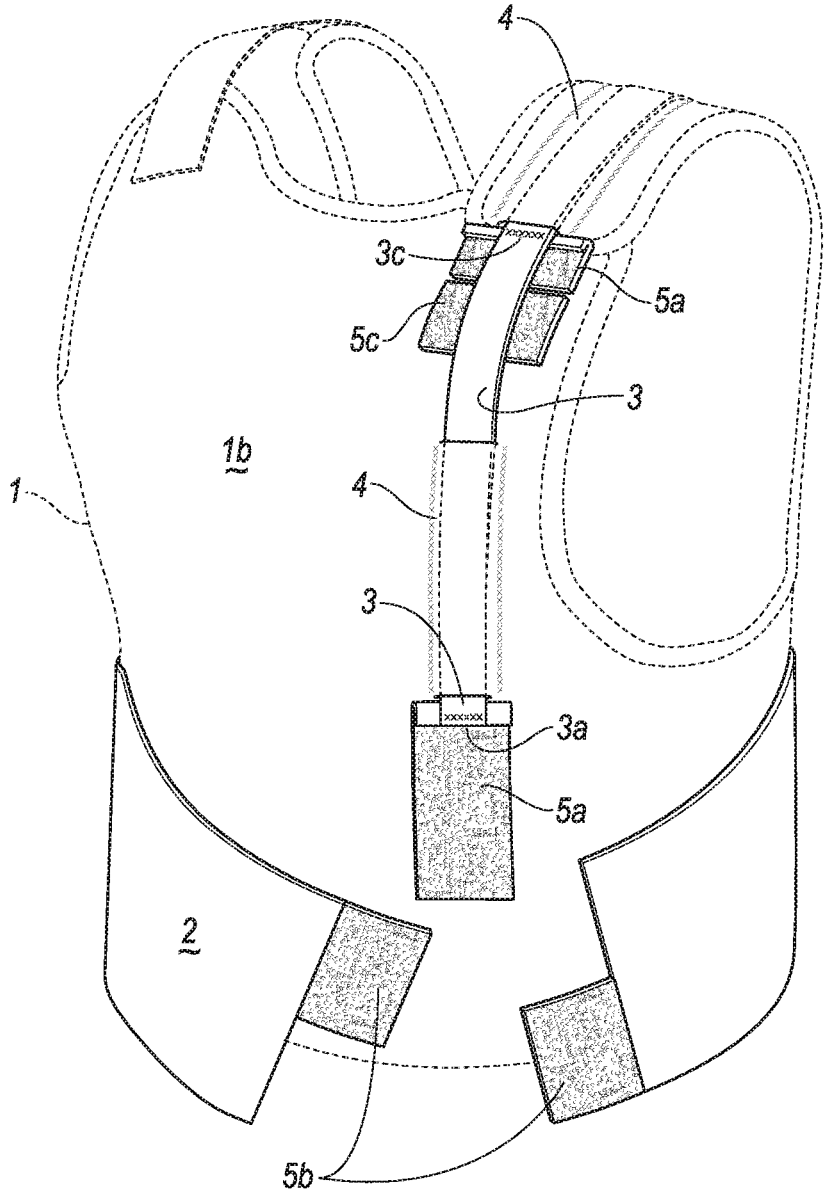
FIG. 15D is an isometric view of the back portion of the vest of FIGS. 15A and 15B.

Referring to FIGS. 15A, 15B, and 15C, in some implementations, a single quick release fastening system is utilized to simultaneously disengage two hook and loop fasteners by peeling a first connector 5 at the first end 2*a* of the cummerbund 2 and a second connector 5 at a shoulder strap 8 of the vest 1.

A conduit 4, in which a single pull cord 3 partially resides, is formed partially through the front portion 1*a* and the shoulder strap 8 of the vest 1 and partially through the back portion 1*b* of the vest 1. The pull cord 3 is attached to the connector 5 of the shoulder strap 8 of the vest 1 at a non-end attachment 3*c* of the pull cord 3 and the first end 3*a* of the pull cord 3 is also attached to the connector 5 at the first end 2*a* of the cummerbund.

Figure 15E:
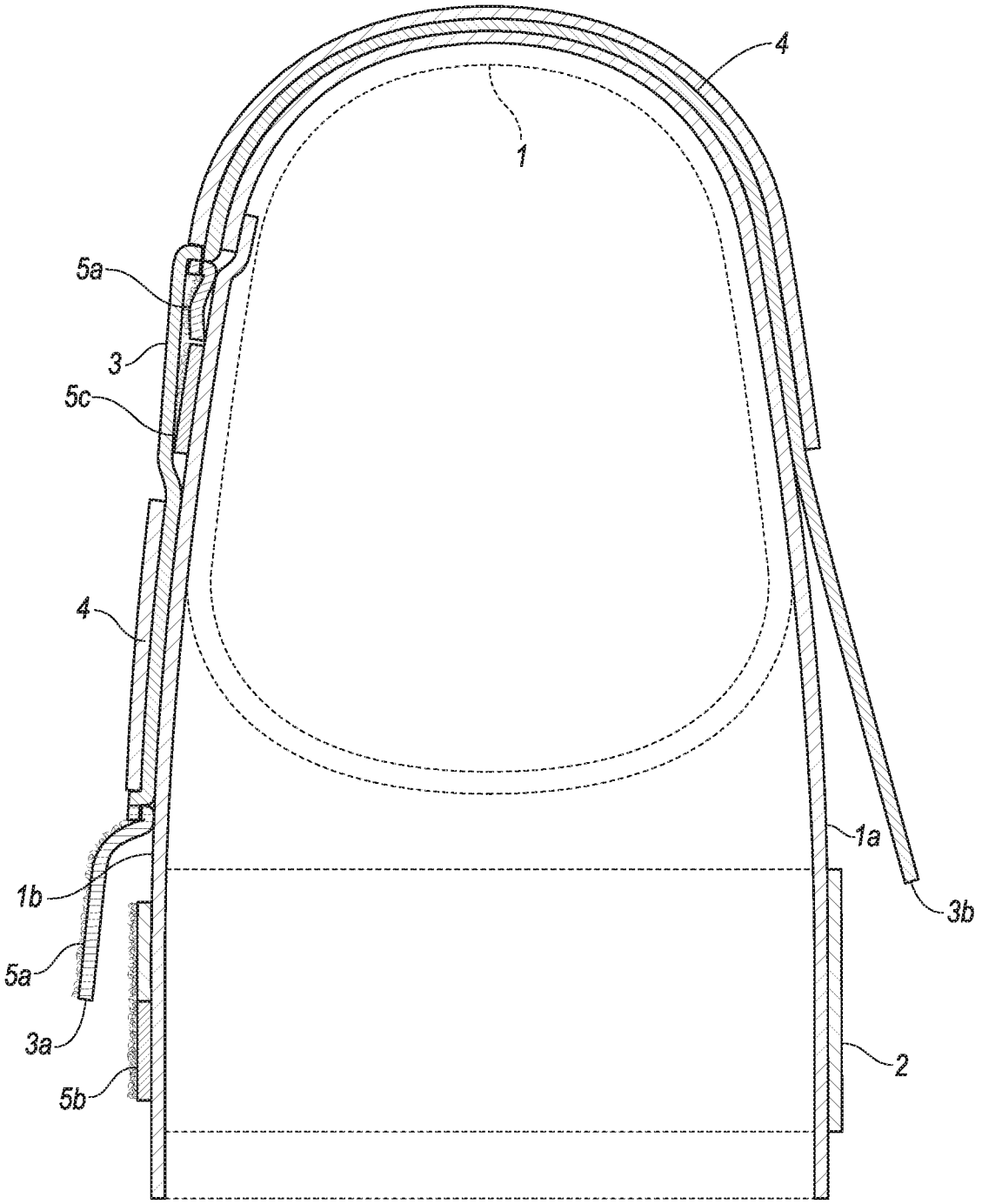
FIG. 15E is a sectional view of the vest of FIGS. 15A and 15B.

Referring to FIGS. 15D and 15E, in some implementations, the user may engage the quick release mechanism by a frontal pull of the second end 3*b* of the pull cord 3. The frontal pull causes the first end 3*a* of the pull cord 3 to vertically peel the pull tab portion 5*a* of the connector 5 from the cummerbund portion 5*b* of the connector 5 to disengage the hook and loop fastener. The frontal pull also causes the non-end attachment 3*c* of the pull cord 3 to vertically peel the pull tab portion 5*a* of the connector 5 from the affixed portion 5*c* of the connector 5.

Figure 16A:
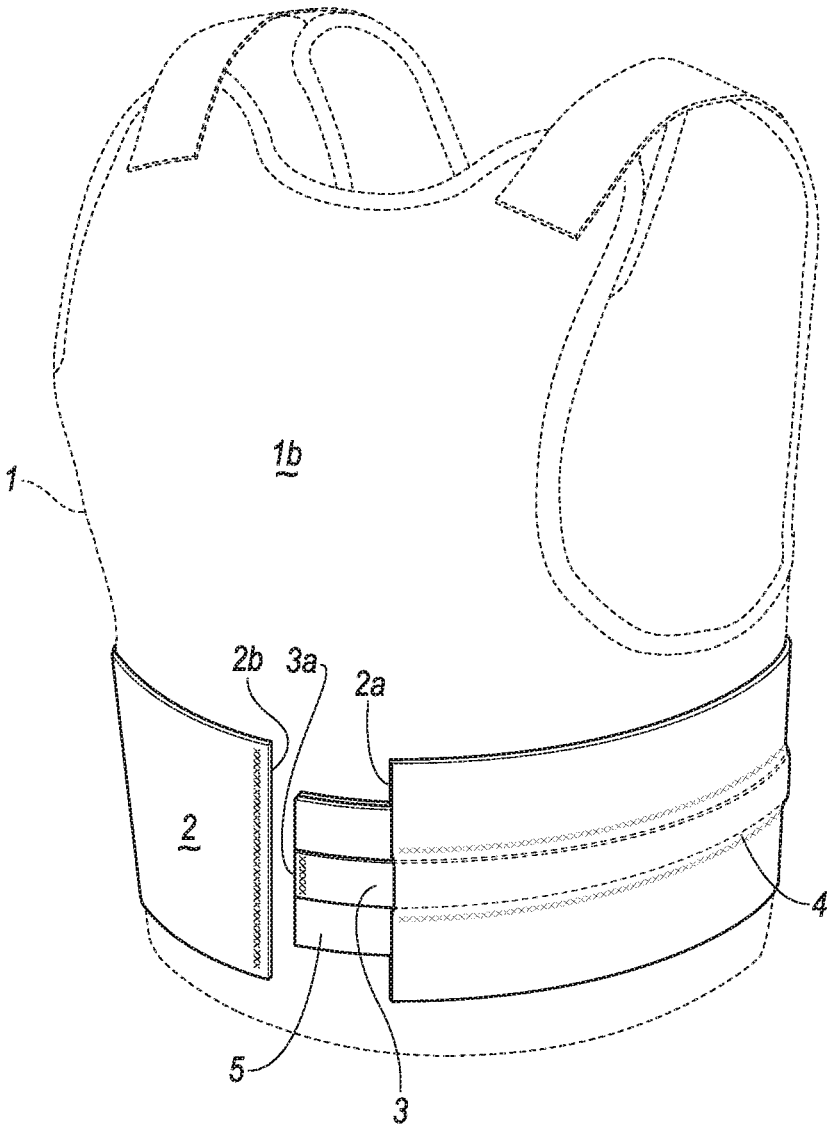
FIG. 16A is an isometric view of the back portion of a vest including a cummerbund that utilizes another exemplary implementation of the quick release fastening system. The fastening system of the cummerbund of FIG. 16A utilizes a design which allows the connector at one end of the cummerbund to fasten to the back portion of the vest.
Figure 16B:
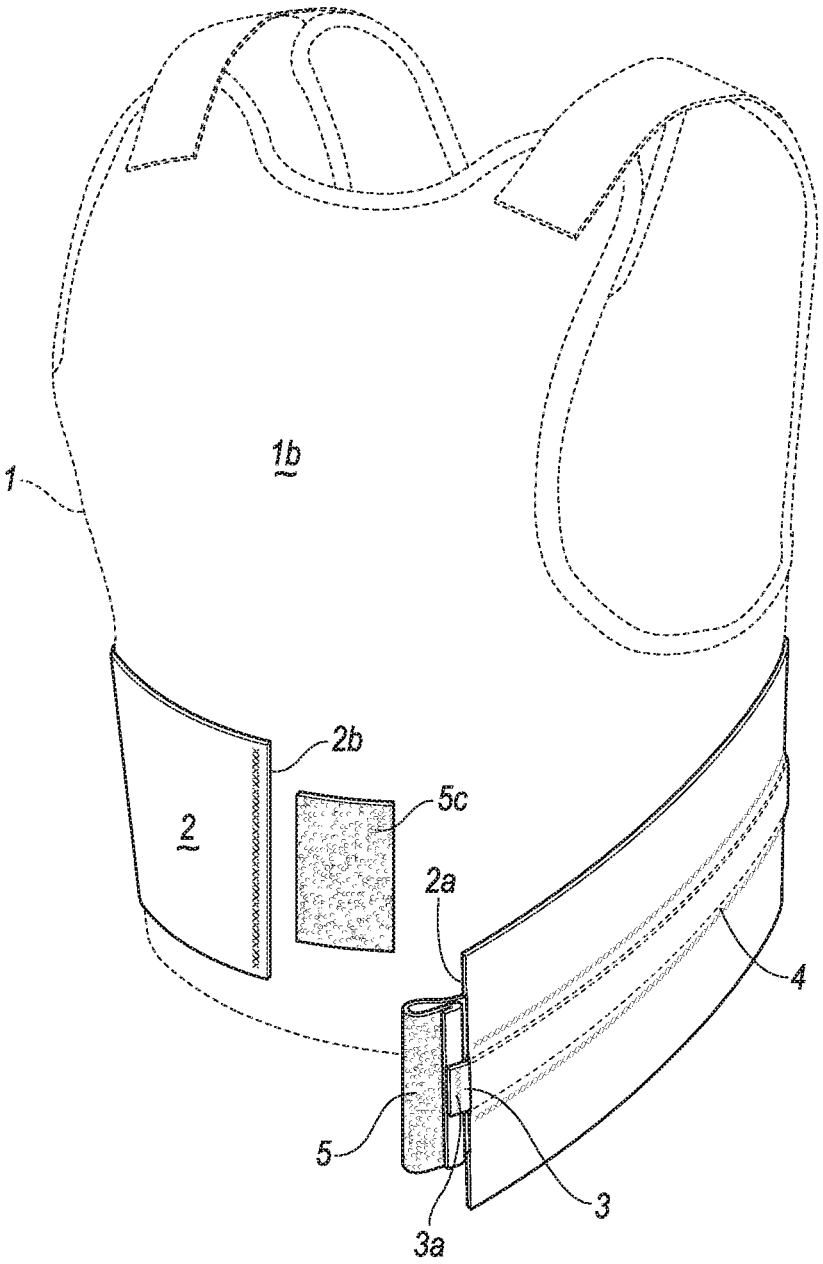
FIG. 16B is an isometric view of the back portion of the vest of FIG. 16A.

Referring to FIGS. 16A and 16B, in some implementations, the second end 2*b* of the cummerbund 2 is affixed to the back portion 1*b* of the vest 1. The first end 2*a* of the cummerbund 2 terminates into a connector 5. The first end 3*a* of the pull cord 3 is affixed to the connector 5.

Referring specifically to FIG. 16B, the user's frontal pull of the second end 3*b* of the pull cord 3 engages the quick release fastening system, resulting in the first end 3*a* of the pull cord 3 peeling the connector 5 to disengage the hook and loop fastener. The affixed portion 5*c* of the connector 5, comprising either a hook portion or a loop portion of a hook and loop fastener, is disposed on the lower back portion 1*b* of the vest 1.

After engagement of the quick release fastening system, the second end 2*b* of the cummerbund 2 remains, in the exemplary embodiment of FIG. 16B, attached to the back portion 1*b* of the vest 1. In addition to this embodiment, the present disclosure includes other similar embodiments utilizing an affixed portion 5*c* of the connector 5 at the lower back portion 1*b* of the vest 1. For example, the second end 2*b* of the cummerbund 2 could include an additional connector 5, comprising either a hook portion or a loop portion of a hook and loop connector, that fastens directly to the affixed portion 5*c* of the connector 5.

Figure 17A:
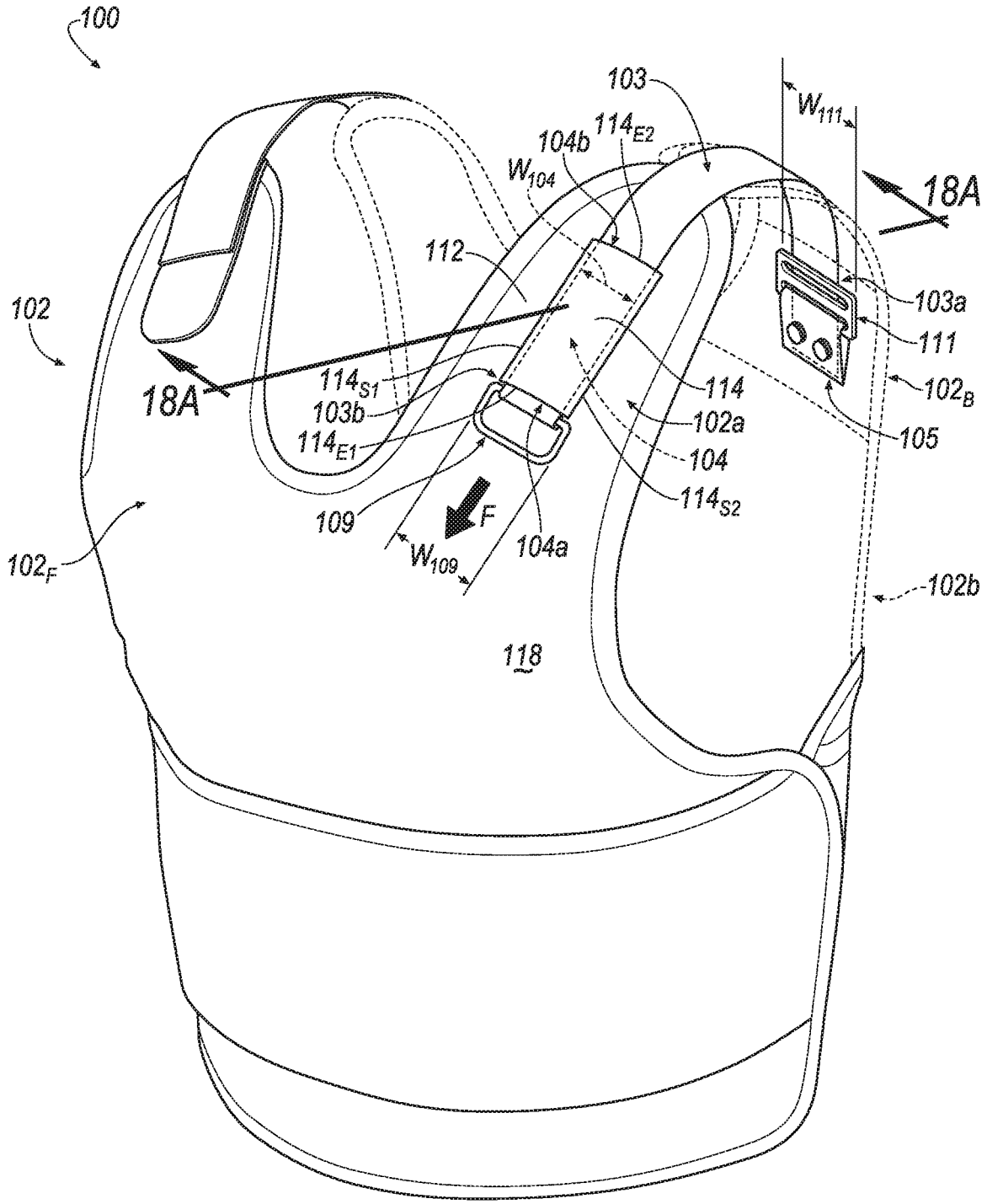
FIG. 17A is a front perspective view of an exemplary apparatus.
Figure 17B:
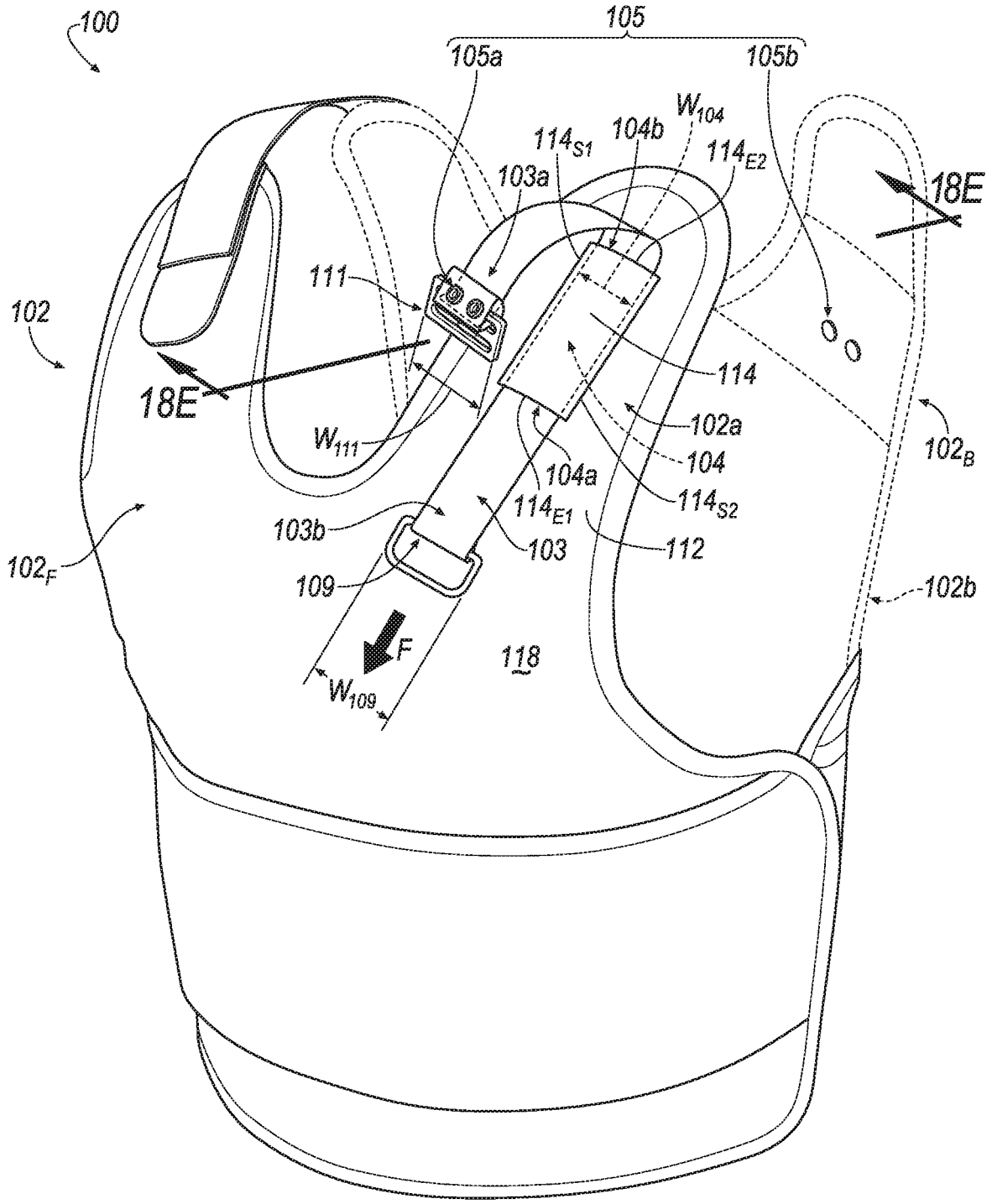
FIG. 17B is a rear perspective view of the apparatus of FIG. 17A.

An exemplary apparatus is shown generally at 100 in FIGS. 17A-17B and 18A-18E. The apparatus 100 includes "quick release" structure that may permit, for example, a person wearing the apparatus 100 to quickly disconnect and remove the apparatus 100. Although the "quick release" structure is shown at FIGS. 17A-17B relative what may be referred to as a "shoulder region" of a person that may wear the apparatus 100, the "quick release" structure may be arranged at any region of the apparatus 100 (e.g., about an abdominal or a waist region of a person that may wear the apparatus 100).

With reference to FIGS. 17A and 17B, the apparatus 100 includes an article of clothing 102 comprising a first end 102*a* and a second end 102*b*. The apparatus 100 also includes a quick-release fastener 105. As seen more clearly in FIG. 17B, the quick-release fastener 105 includes a peelable portion 105*a* supported by the first end 102*a* of the article of clothing 102 and a fixed portion 105*b* supported by the second end 102*b* of the article of clothing 102.

Figure 18A:
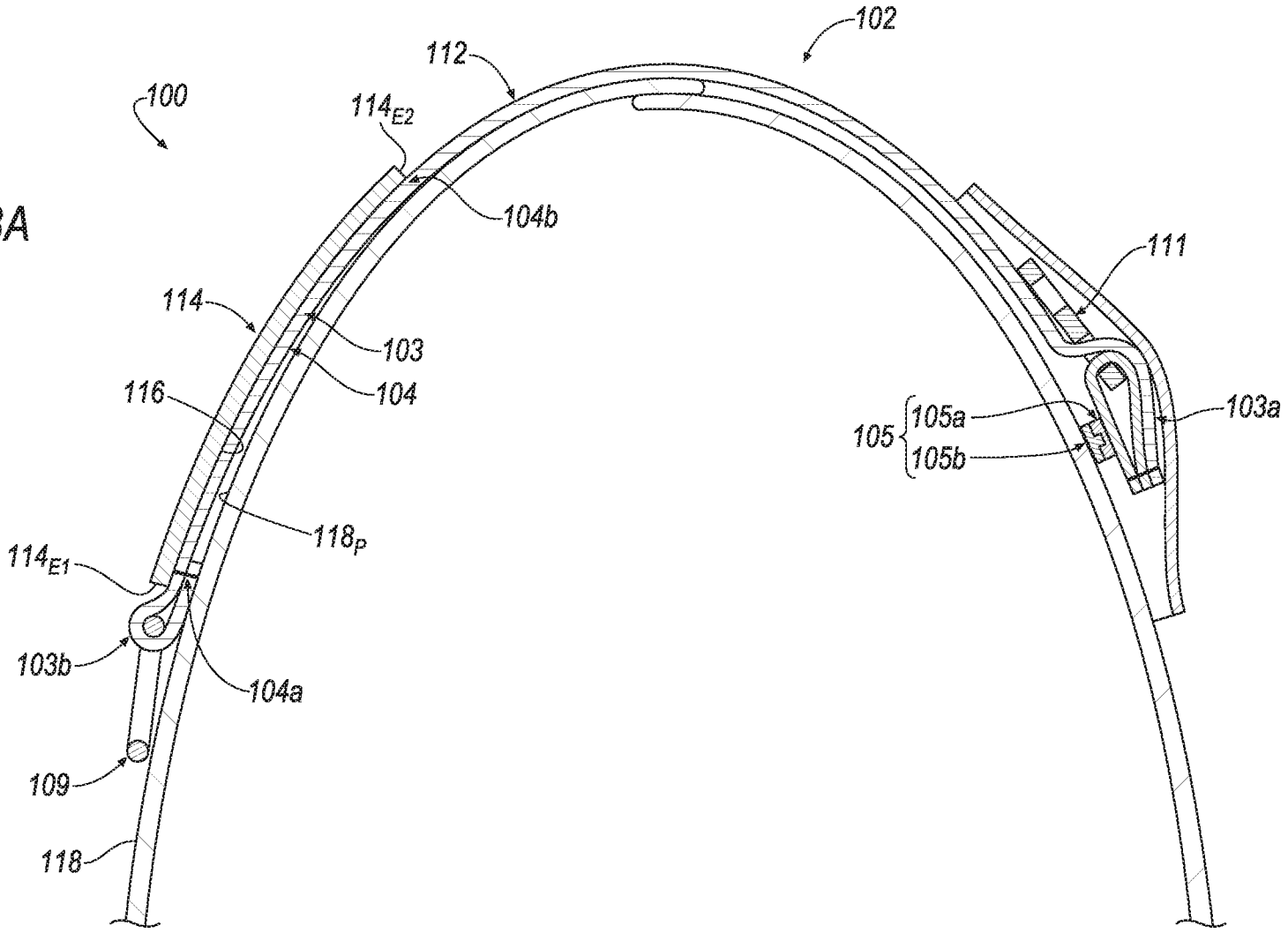
FIGS. 18A-18E are cross-sectional views of a method for operating the apparatus according to lines 18A-18A and 18E-18E of FIGS. 17A and 17B, respectively.
Figure 18B:
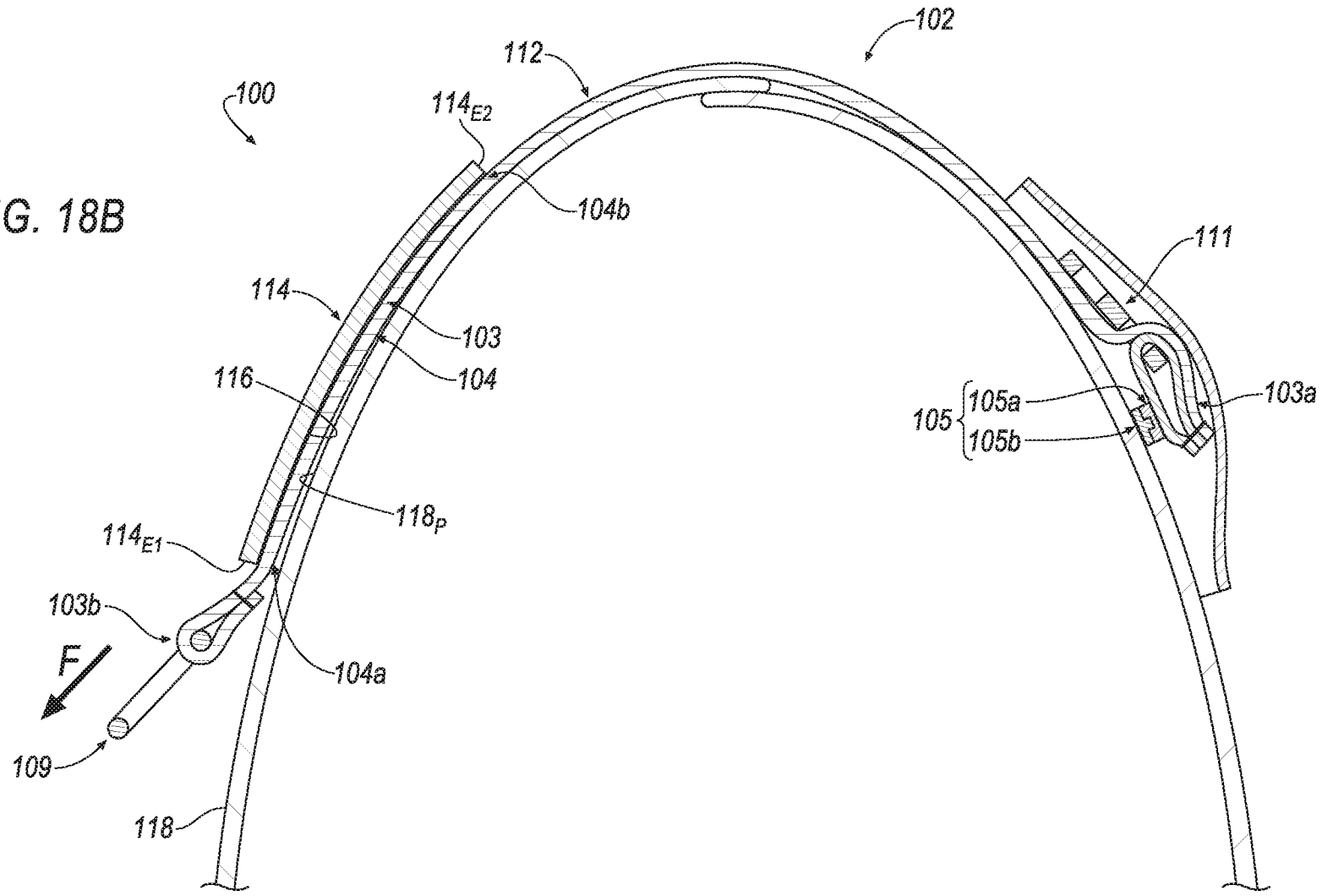
Figure 18C:
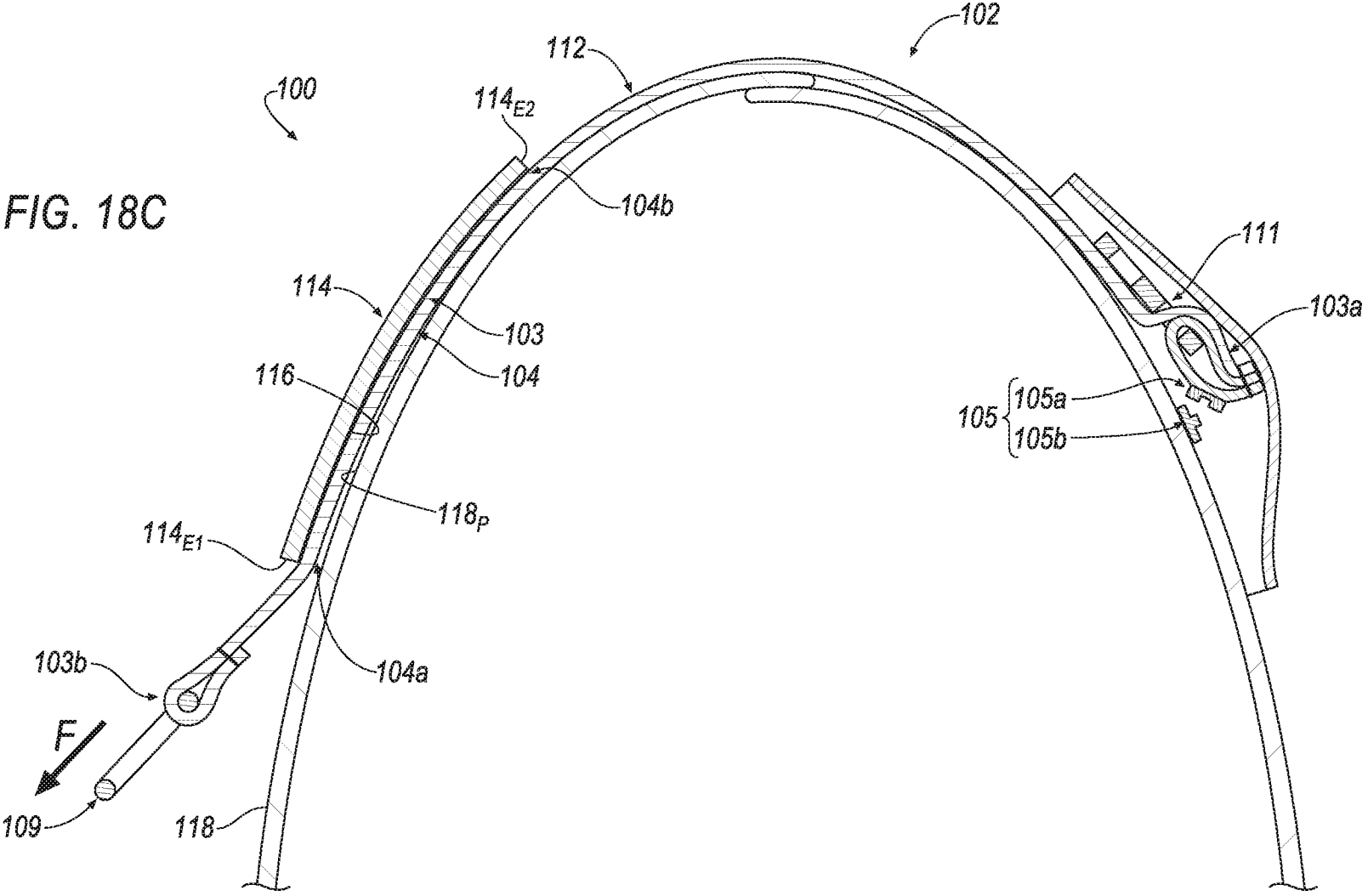
Figure 18D:
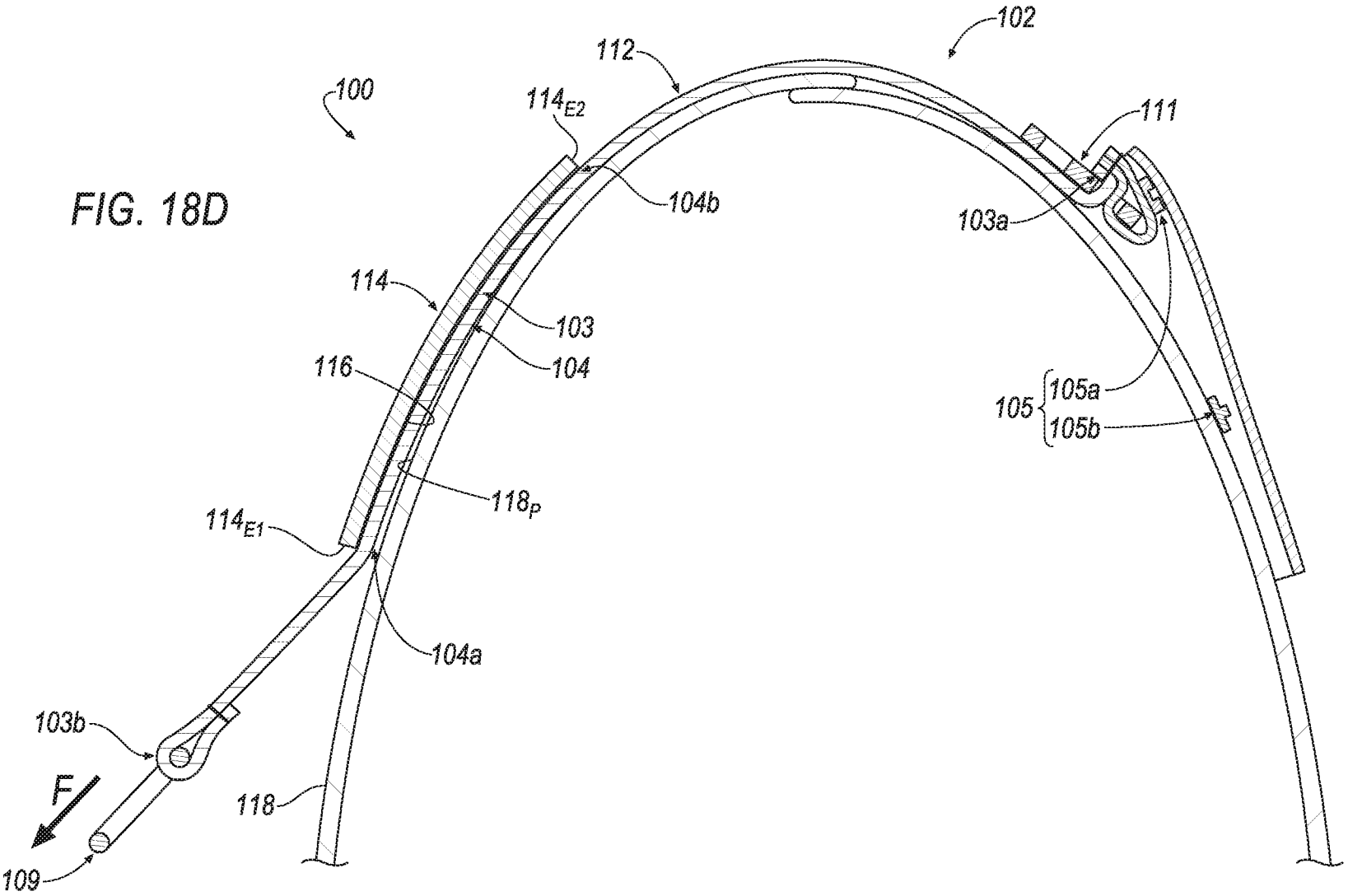
Figure 18E:
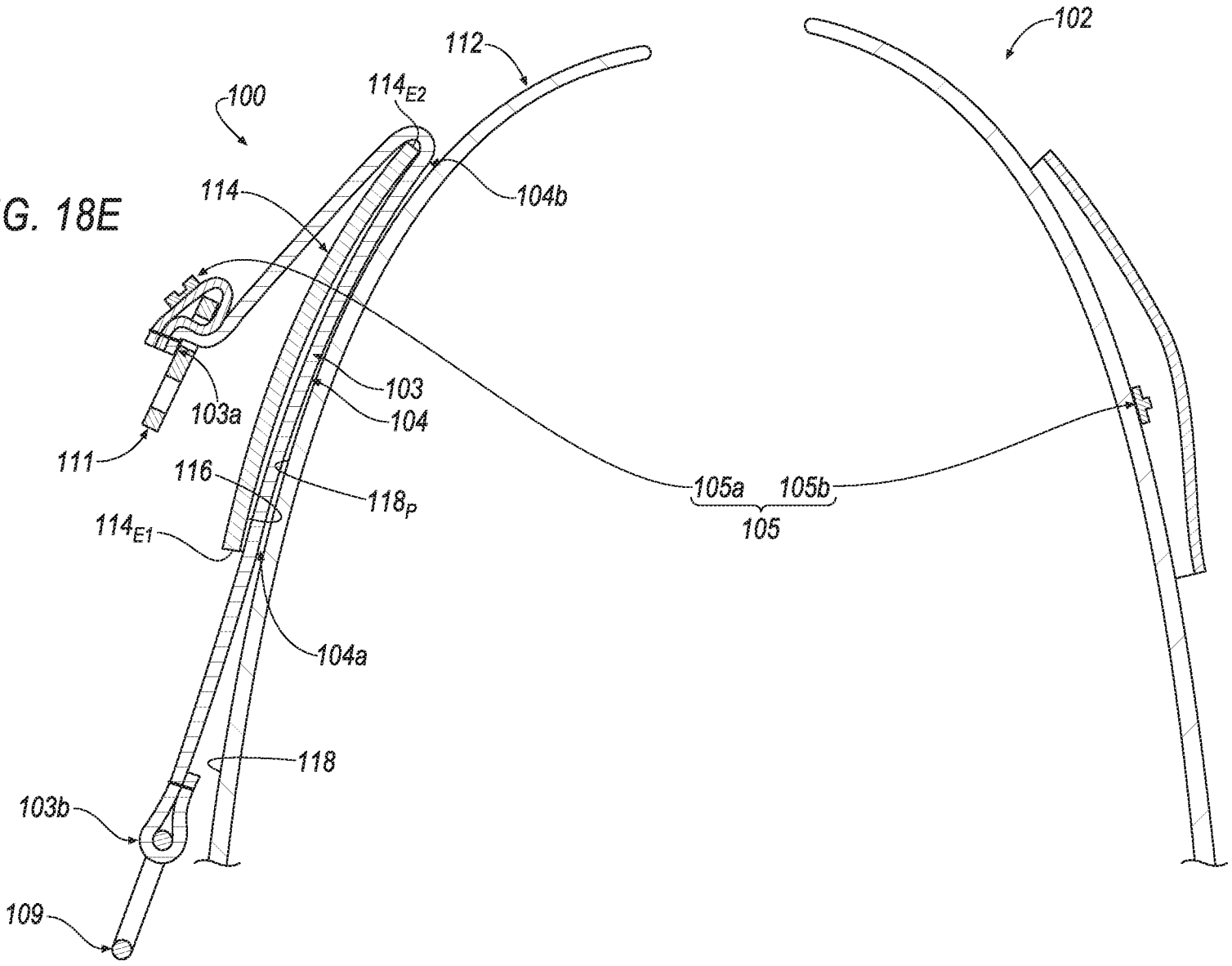

As seen in FIGS. 17A and 18A-18B, the quick release fastener 105 may be arranged in a fastened state whereby the peelable portion 105*a* is selectively-attached to and overlapped with the fixed portion 105*b*. Conversely, as seen in FIGS. 17B and 18C-18E, the quick release fastener 105 may be arranged in an unfastened state whereby the peelable portion 105*a* is not selectively-attached to and is not overlapped with the fixed portion 105*b*.

With reference to FIGS. 17A-17B, the apparatus 100 may further include a pull cord 103 movably-supported upon the article of clothing 102. As seen more clearly in FIG. 17B, the pull cord 103 includes a peelable end 103*a* and a handle end 103*b*. The peelable end 103*a* of the pull cord 103 supports the peelable portion 105*a* of the quick-release fastener 105.

As seen in FIGS. 17A and 18A-18B, the peelable end 103*a* of the pull cord 103 that supports the peelable portion 105*a* extends across the fixed portion 105*b* to permit selective attachment of the peelable portion 105*a* to the fixed portion 105*b* for arranging the quick-release fastener 105 in the fastened state. Furthermore, as seen in FIGS. 17B and 18C-18E, in response to a pulling force F applied to the handle end 103*b* of the pull cord 103, the peelable end 103*a* of the pull cord 103 that supports the peelable portion 105*a* is selectively-detached from the fixed portion 105*b* for arranging the quick-release fastener 105 in the unfastened state.

As seen in FIGS. 17A-17B and 18A-18E, the pull cord 103 is moveably-arranged within a conduit 104 formed by the article of clothing 102. The handle end 103*b* of the pull cord 103 extends outside of a first end 104*a* of the conduit 104. The peelable end 103*a* of the pull cord 103 extends outside of a second end 104*b* of the conduit 104.

In an example, the quick-release fastener 105 may be any desirable fastener such as, for example, a snap fastener. The peelable portion 105*a* of the snap fastener 105 may be one of a male portion and a female portion; the fixed portion 105*b* of the snap fastener 105 is the other of the male portion and the female portion. As seen in FIGS. 17B and 18A-18E, the peelable portion 105*a* may be defined by a female portion of the snap fastener 105, and the fixed portion 105*b* may be defined by a male portion of the snap fastener 105.

In some implementations, the peelable end 103*a* of the pull cord 103 is directly fastened to the peelable portion 105*a* of the quick-release fastener 105. In other implementations, the peelable end 103*a* of the pull cord 103 is adjacently fastened to the peelable portion 105*a* of the quick-release fastener 105. In other examples, the peelable end 103*a* of the pull cord 103 is a distal end of the pull cord 103. In other instances, the handle end 103*b* of the pull cord 103 is a proximal end of the pull cord 103 having a user-engaging portion 109.

In some examples, the user-engaging portion 109 includes a handle member secured to the handle end 103*b* of the pull cord 103. In some instances, the peelable end 103*a* of the pull cord 103 includes a pull stop member 111. Each of the handle member 109 and the pull stop member 111 may be defined by a dimension (e.g., a width dimension $W_{109}$, $W_{111}$) that is greater than a passage dimension (e.g., a passage width dimension $W_{104}$) of the conduit 104 in order to prevent the pull cord 103 from being completely pulled through and out of the conduit 104.

Referring to FIGS. 17A-17B, the article of clothing 102 may include a base portion 112 and a patch portion 114. A first side $\mathbf{114}_{S1}$ of the patch portion 114 may be secured to the base portion 112, and a second side $\mathbf{114}_{S2}$ of the patch portion 114 that is opposite the first side $\mathbf{114}_{S1}$ of the patch portion 114 may be secured to the base portion 112. In an example, each of the first side $\mathbf{114}_{S1}$ of the patch portion 114 and the second side $\mathbf{114}_{S2}$ of the patch portion 114 may be secured to the base portion 112 with a threaded connection. As a result, with corresponding reference to FIGS. 18A-18E, a surface 116 of the patch portion 114 that directly faces a portion $\mathbf{118}_{P}$ of an outer surface 118 of the base portion 112 defines the conduit 104.

Each of a first end $\mathbf{114}_{E1}$ of the patch portion 114 and a second end $\mathbf{114}_{E2}$ of the patch portion 114 are not secured to the base portion 112. In an example, the first end $\mathbf{114}_{E1}$ of the patch portion 114 may at least partially define a proximal conduit opening that permits access to the first end 104*a* of the conduit 104. Similarly, the second end $\mathbf{114}_{E2}$ of the patch portion 114 may at least partially define a distal conduit opening that permits access to the second end 104*b* of the conduit 104.

As seen in FIGS. 17A-17B, the article of clothing 102 may be a vest. In an example, the "quick release" structure provided by the apparatus 100 may located relative what may be referred to as a "shoulder region" of a person that may wear the apparatus 100. Furthermore, in some instances, the fixed portion 105*b* of the quick-release fastener 105 may be attached to the vest 102. In an example, the vest 102 may be generally defined by a back portion $\mathbf{102}_B$ that is configured to extend over and conform to a wearer's back region and a front portion $\mathbf{102}_F$ that is configured to extend over and conform to a wearer's chest and abdominal region.

In some instances, the peelable portion 105*a* and the fixed portion 105*b* of the quick-release fastener 105 are arranged upon the back portion $\mathbf{102}_B$ of the vest 102 when the peelable portion 105*a* is selectively-attached to and overlapped with the fixed portion 105*b*. Furthermore in an example, the handle end 103*b* of the pull cord 103 may be movably arranged upon the front portion $\mathbf{102}_F$ of the vest 102.

Although the illustrated exemplary embodiment described at FIGS. 17A-17B and 18A-18E illustrates an article of clothing 102 configured in the form of a vest, the article of clothing 102 is not limited to vests. For example, the article of clothing may be a cummerbund or elongated strap as described above in preceding embodiments and Figures.

Figure 19A:
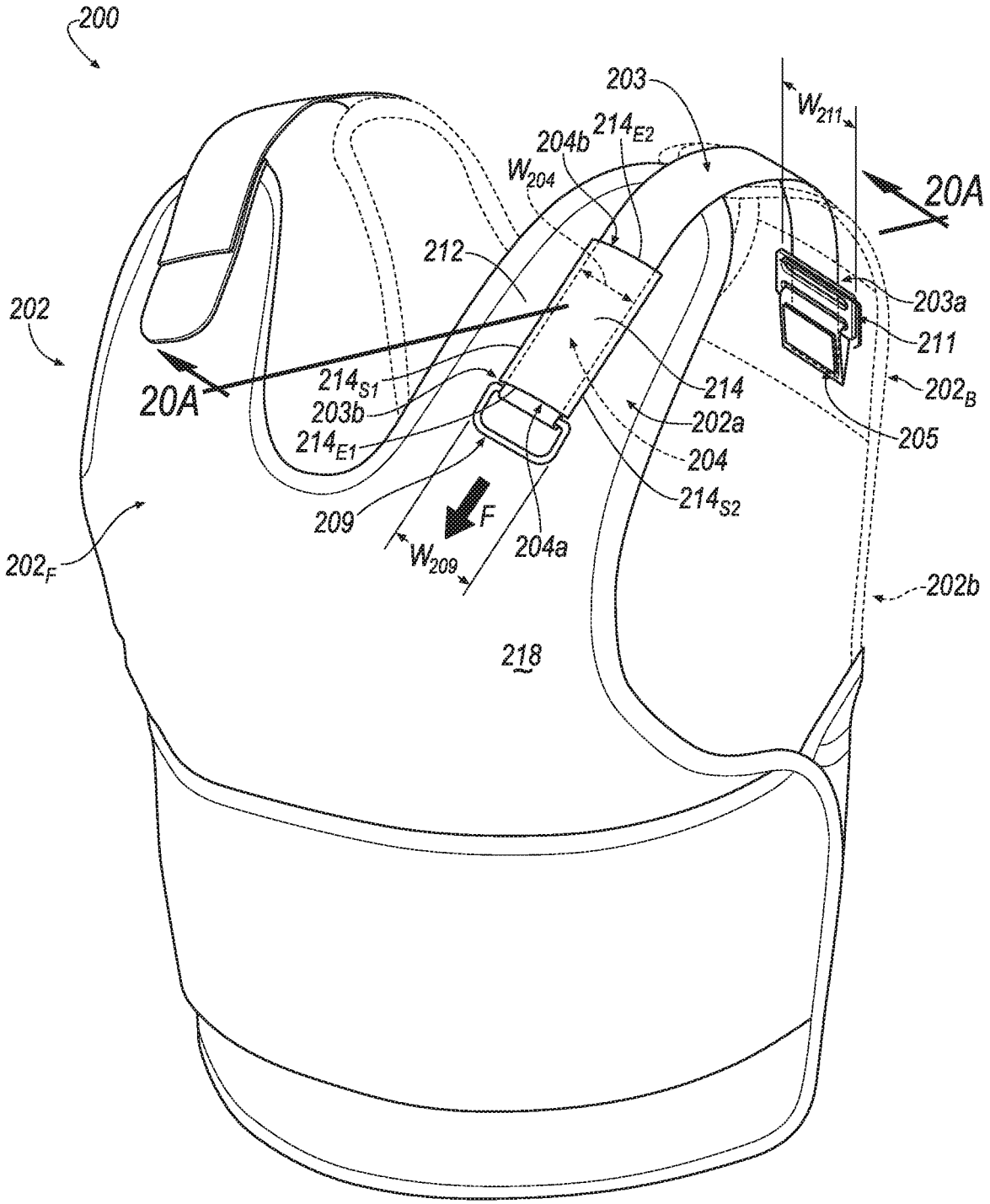
FIG. 19A is a front perspective view of an exemplary apparatus.
Figure 19B:
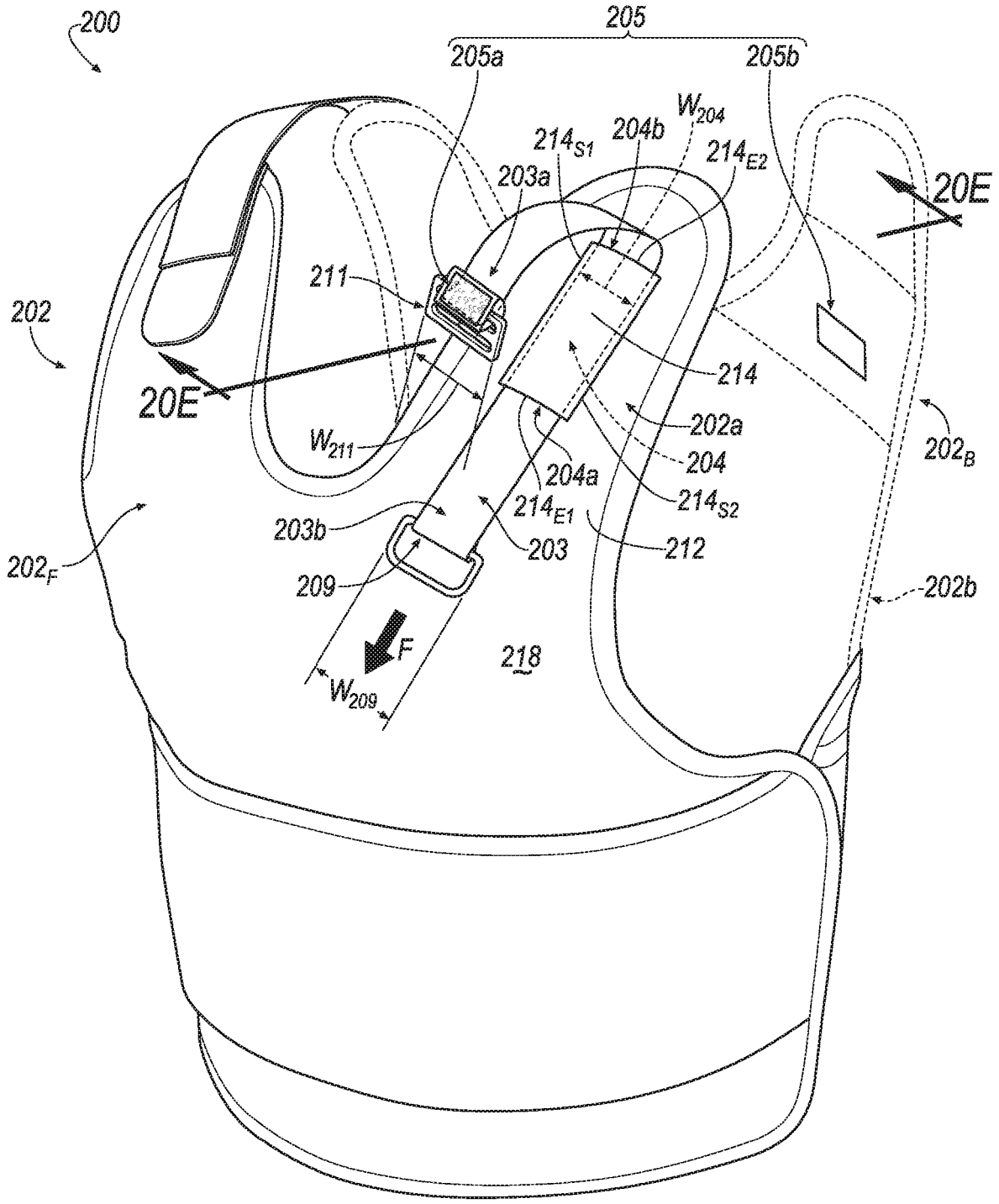
FIG. 19B is a rear perspective view of the apparatus of FIG. 19A.

An exemplary apparatus is shown generally at 200 in FIGS. 19A-19B and 20A-20E. The apparatus 200 includes "quick release" structure that may permit, for example, a person wearing the apparatus 200 to quickly disconnect and remove the apparatus 200. Although the "quick release" structure is shown at FIGS. 19A-19B relative what may be referred to as a "shoulder region" of a person that may wear the apparatus 200, the "quick release" structure may be arranged at any region of the apparatus 200 (e.g., about an abdominal or a waist region of a person that may wear the apparatus 200).

With reference to FIGS. 19A and 19B, the apparatus 200 includes an article of clothing 202 comprising a first end 202*a* and a second end 202*b*. The apparatus 200 also includes a quick-release fastener 205. As seen more clearly in FIG. 19B, the quick-release fastener 205 includes a peelable portion 205*a* supported by the first end 202*a* of the article of clothing 202 and a fixed portion 205*b* supported by the second end 202*b* of the article of clothing 202.

Figure 20A:
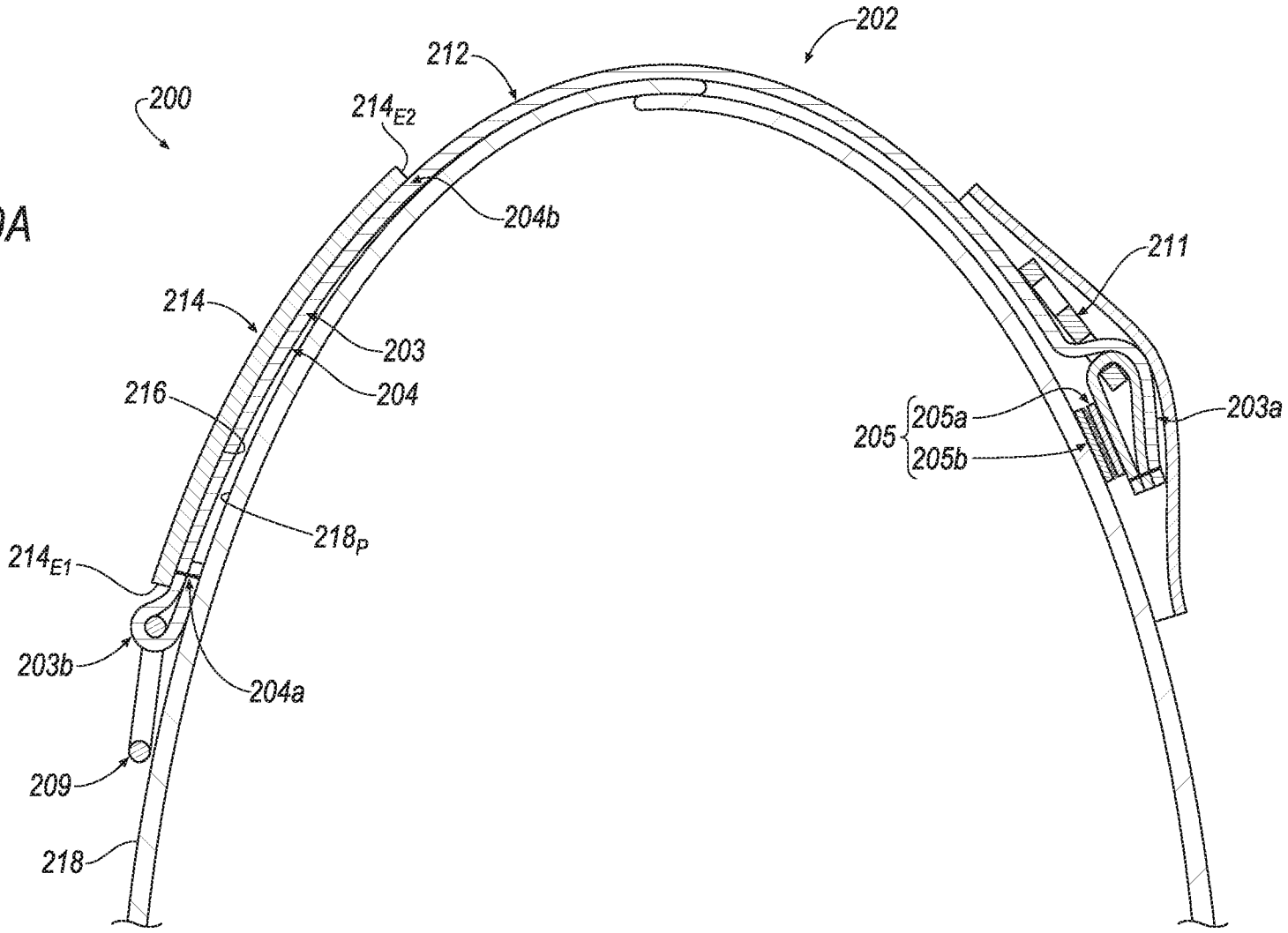
FIGS. 20A-20E are cross-sectional views of a method for operating the apparatus according to lines 20A-20A and 20E-20E of FIGS. 19A and 19B, respectively.
Figure 20B:
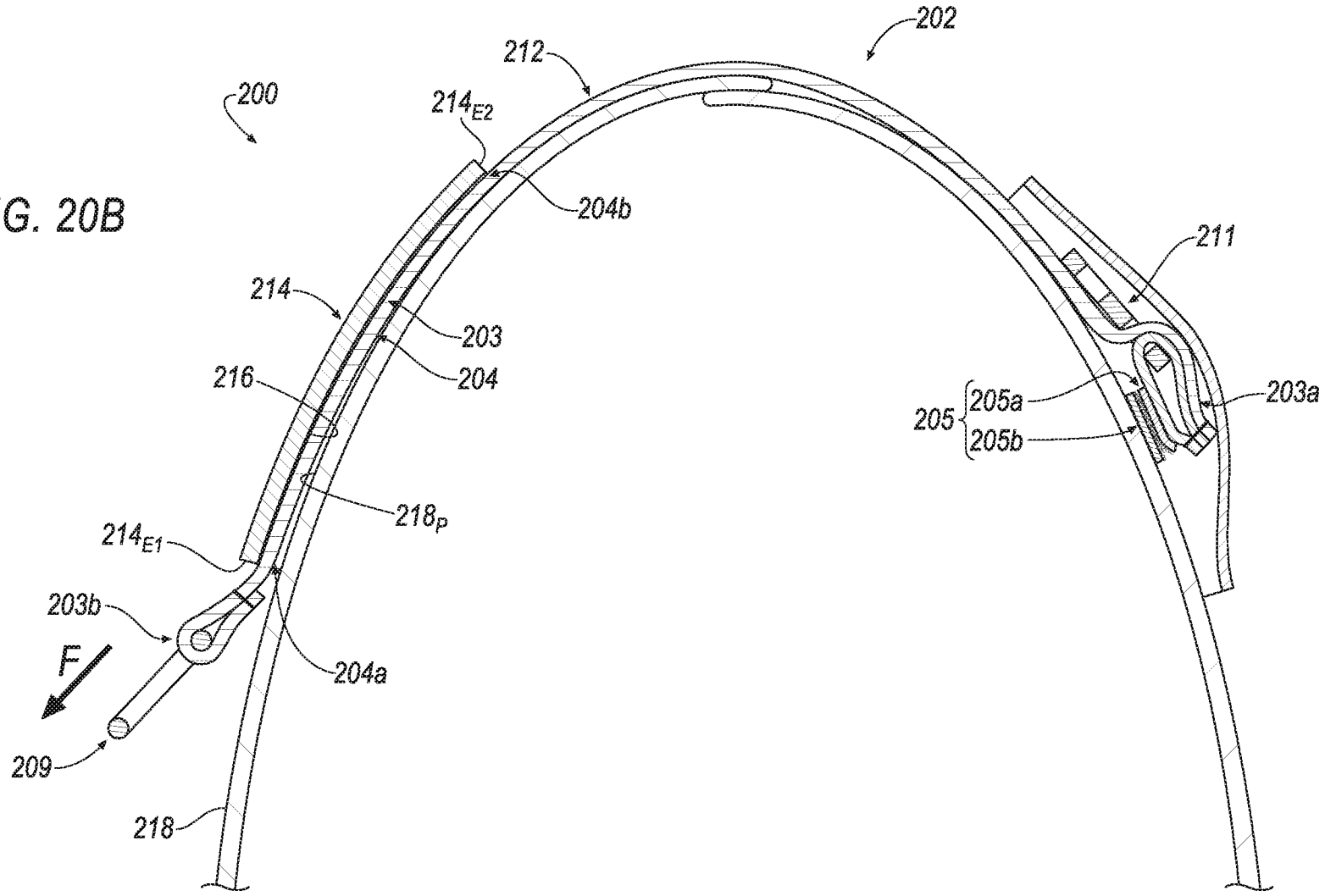
Figure 20C:
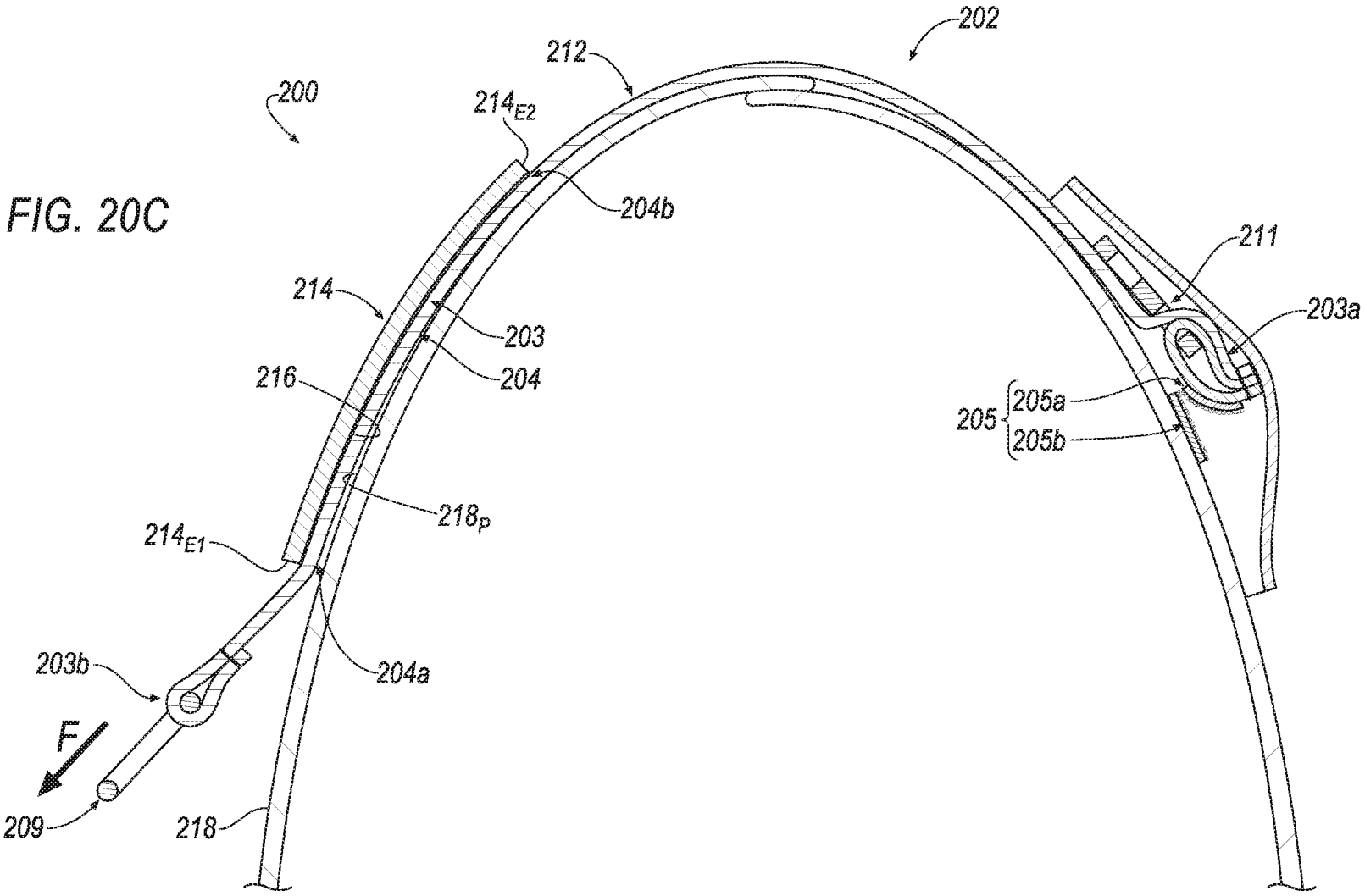
Figure 20D:
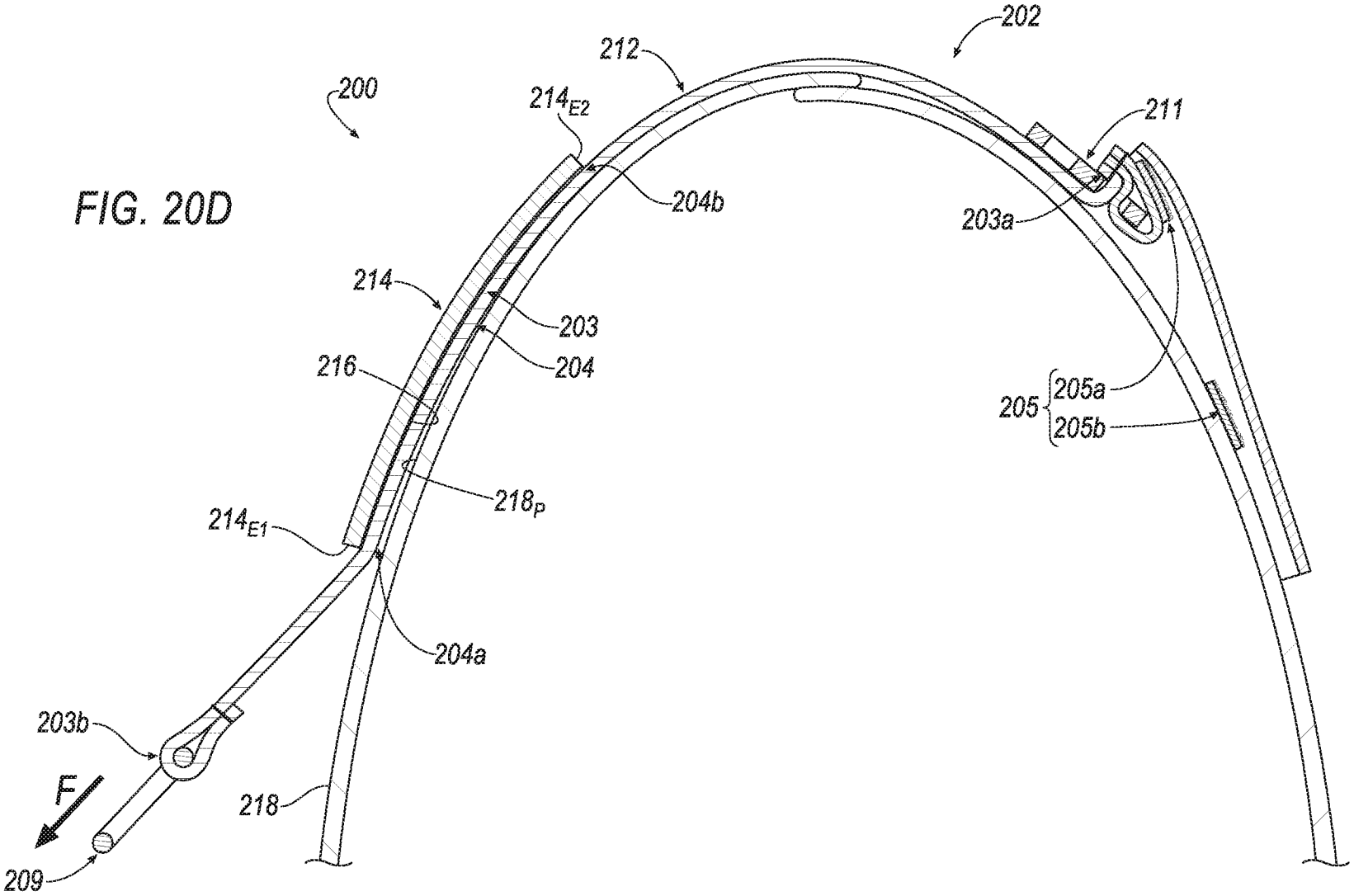
Figure 20E:
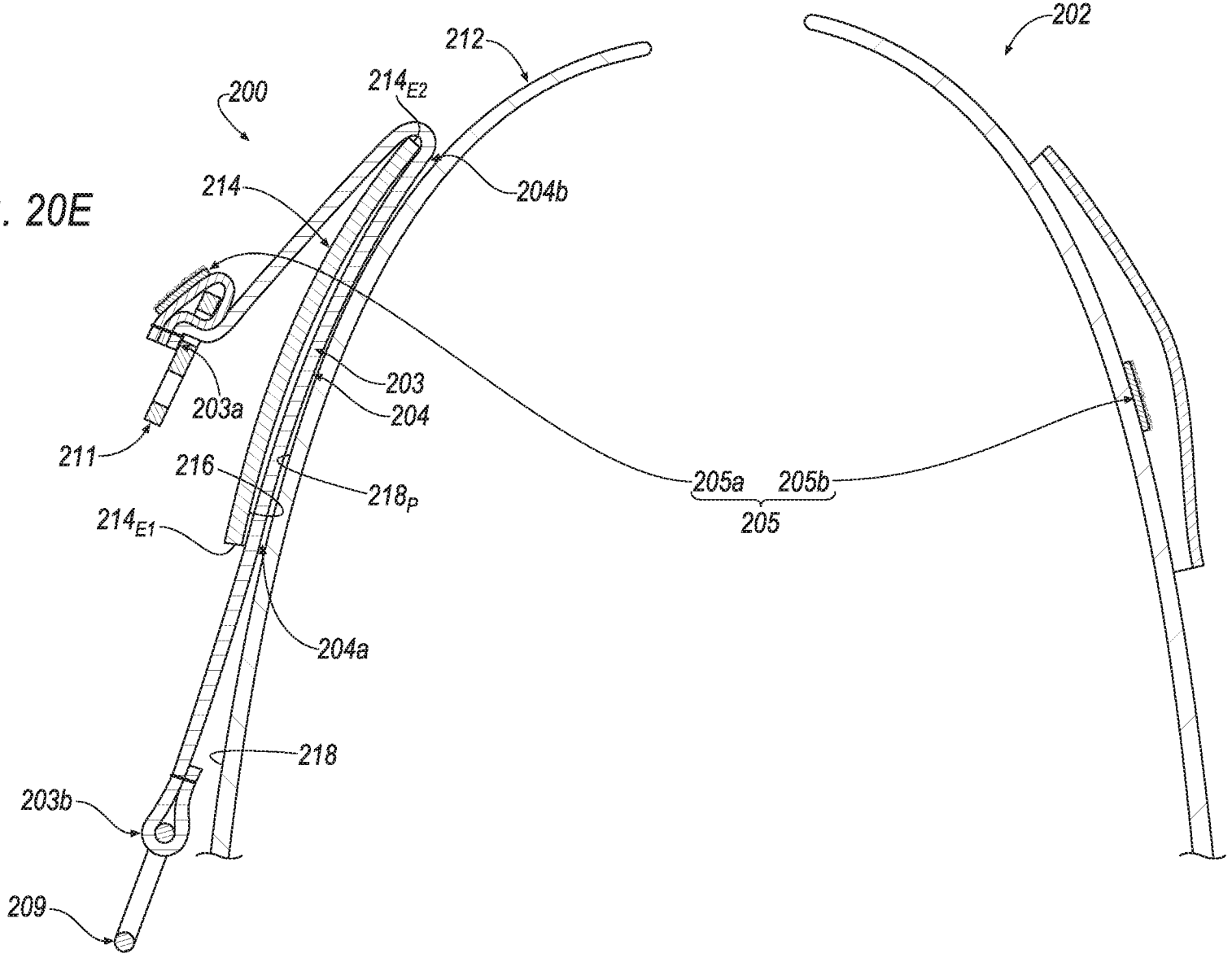

As seen in FIGS. 19A and 20A-20B, the quick release fastener 205 may be arranged in a fastened state whereby the peelable portion 205*a* is selectively-attached to and overlapped with the fixed portion 205*b*. Conversely, as seen in FIGS. 19B and 20C-20E, the quick release fastener 205 may be arranged in an unfastened state whereby the peelable portion 205*a* is not selectively-attached to and is not overlapped with the fixed portion 205*b*.

With reference to FIGS. 19A-19B, the apparatus 200 may further include a pull cord 203 movably-supported upon the article of clothing 202. As seen more clearly in FIG. 19B, the pull cord 203 includes a peelable end 203*a* and a handle end 203*b*. The peelable end 203*a* of the pull cord 203 supports the peelable portion 205*a* of the quick-release fastener 205.

As seen in FIGS. 19A and 20A-20B, the peelable end 203*a* of the pull cord 203 that supports the peelable portion 205*a* extends across the fixed portion 205*b* to permit selective attachment of the peelable portion 205*a* to the fixed portion 205*b* for arranging the quick-release fastener 205 in the fastened state. Furthermore, as seen in FIGS. 19B and 20C-20E, in response to a pulling force F applied to the handle end 203*b* of the pull cord 203, the peelable end 203*a* of the pull cord 203 that supports the peelable portion 205*a* is selectively-detached from the fixed portion 205*b* for arranging the quick-release fastener 205 in the unfastened state.

As seen in FIGS. 19A-19B and 20A-20E, the pull cord 203 is moveably-arranged within a conduit 204 formed by the article of clothing 202. The handle end 203*b* of the pull cord 203 extends outside of a first end 204*a* of the conduit 204. The peelable end 203*a* of the pull cord 203 extends outside of a second end 204*b* of the conduit 204.

In an example, the quick-release fastener 205 may be any desirable fastener such as, for example, a hook-and-loop fastener. The peelable portion 205*a* of the hook-and-loop fastener 205 may be one of a hook portion and a loop portion; the fixed portion 205*b* of the hook-and-loop fastener 205 is the other of the hook portion and the loop portion. As seen in FIGS. 19B and 20A-20E, the peelable portion 205*a* may be defined by a hook portion of the hook-and-loop fastener 205, and the fixed portion 205*b* may be defined by a loop portion of the hook-and-loop fastener 205.

In some implementations, the peelable end 203*a* of the pull cord 203 is directly fastened to the peelable portion 205*a* of the quick-release fastener 205. In other implementations, the peelable end 203*a* of the pull cord 203 is adjacently fastened to the peelable portion 205*a* of the quick-release fastener 205. In other examples, the peelable end 203*a* of the pull cord 203 is a distal end of the pull cord 203. In other instances, the handle end 203*b* of the pull cord 203 is a proximal end of the pull cord 203 having a user-engaging portion 209.

In some examples, the user-engaging portion 209 includes a handle member secured to the handle end 203*b* of the pull cord 203. In some instances, the peelable end 203*a* of the pull cord 203 includes a pull stop member 211. Each of the handle member 209 and the pull stop member 211 may be defined by a dimension (e.g., a width dimension $W_{209}$, $W_{211}$) that is greater than a passage dimension (e.g., a passage width dimension $W_{204}$) of the conduit 204 in order to prevent the pull cord 203 from being completely pulled through and out of the conduit 204.

Referring to FIGS. 19A-19B, the article of clothing 202 may include a base portion 212 and a patch portion 214. A first side $\mathbf{214}_{S1}$ of the patch portion 214 may be secured to the base portion 212, and a second side $\mathbf{214}_{S2}$ of the patch portion 214 that is opposite the first side $\mathbf{214}_{S1}$ of the patch portion 214 may be secured to the base portion 212. In an example, each of the first side $\mathbf{214}_{S1}$ of the patch portion 214 and the second side $\mathbf{214}_{S2}$ of the patch portion 214 may be secured to the base portion 212 with a threaded connection. As a result, with corresponding reference to FIGS. 20A-20E, a surface 216 of the patch portion 214 that directly faces a portion $\mathbf{218}_P$ of an outer surface 218 of the base portion 212 defines the conduit 204.

Each of a first end $\mathbf{214}_{E1}$ of the patch portion 214 and a second end $\mathbf{214}_{E2}$ of the patch portion 214 are not secured to the base portion 212. In an example, the first end $\mathbf{214}_{E1}$ of the patch portion 214 may at least partially define a proximal conduit opening that permits access to the first end 204*a* of the conduit 204. Similarly, the second end $\mathbf{214}_{E2}$ of the patch portion 214 may at least partially define a distal conduit opening that permits access to the second end 204*b* of the conduit 204.

As seen in FIGS. 19A-19B, the article of clothing 202 may be a vest. In an example, the "quick release" structure provided by the apparatus 200 may located relative what may be referred to as a "shoulder region" of a person that may wear the apparatus 200. Furthermore, in some instances, the fixed portion 205*b* of the quick-release fastener 205 may be attached to the vest 202. In an example, the vest 202 may be generally defined by a back portion $\mathbf{202}_B$ that is configured to extend over and conform to a wearer's back region and a front portion $\mathbf{202}_F$ that is configured to extend over and conform to a wearer's chest and abdominal region.

In some instances, the peelable portion 205*a* and the fixed portion 205*b* of the quick-release fastener 205 are arranged upon the back portion $\mathbf{202}_B$ of the vest 202 when the peelable portion 205*a* is selectively-attached to and overlapped with the fixed portion 205*b*. Furthermore in an example, the handle end 203*b* of the pull cord 203 may be movably arranged upon the front portion $\mathbf{202}_F$ of the vest 202.

Although the illustrated exemplary embodiment described at FIGS. 19A-19B and 20A-20E illustrates an article of clothing 202 configured in the form of a vest, the article of clothing 202 is not limited to vests. For example, the article of clothing may be a cummerbund or elongated strap as described above in preceding embodiments and Figures.

A number of implementations have been described. For example, the implementations disclosed herein have been discussed in conjunction with applications for vests, cummerbunds and the like. However, it is to be understood that in its broadest application, this invention relates to fasteners, and fastening systems irrespective of the application at hand, and, accordingly, any application wherein two articles need to be releasably fastened (such as wearable articles, hand bags, back packs, suit cases, briefcases, tool cases, shipping containers, toys, and the like) may utilize the disclosure. Nevertheless, it will be understood that various modifications may be made without departing from the spirit and scope of the disclosure. Accordingly, other implementations are within the scope of the following claims.

What is claimed is:

1. A system, comprising:

an article of clothing defining a shoulder region having a conduit;

a pull cord movably-supported upon the shoulder region, wherein an intermediate portion of the pull cord extends through the conduit, wherein the pull cord includes a peelable end and a handle end, wherein the handle end is a terminal and free end;

a quick-release fastener including:

a peelable portion directly connected to the peelable end of the pull cord; and a fixed portion directly connected to the shoulder region of the article of clothing, wherein the peelable portion is selectively-attached to and overlapped with the fixed portion, wherein the peelable end of the pull cord that includes the peelable portion directly connected thereto extends across the fixed portion for permitting:

selective attachment of the peelable portion to the fixed portion; and selective detachment of the peelable portion from the fixed portion in response to a pulling force applied to the handle end of the pull cord, wherein the handle end of the pull cord extends outside of a first end of the conduit, wherein the peelable end of the pull cord extends outside of a second end of the conduit.

2. The system of claim 1, wherein the article of clothing is a vest, wherein the vest comprises a back portion and a front portion, wherein the peelable portion and the fixed portion of the quick-release fastener are arranged upon the front portion of the vest, wherein the handle end of said pull cord is movably arranged upon the front portion of the vest.

3. The system of claim 1, wherein the article of clothing is a vest, wherein the vest comprises a back portion and a front portion, wherein the peelable portion and the fixed portion of the quick-release fastener are arranged upon the back portion of the vest, wherein the handle end of said pull cord is movably arranged upon the front portion of the vest.

4. The system of claim 1, wherein the quick-release fastener is defined by:

a hook-and-loop fastener, wherein the peelable portion is defined by one of:

a loop portion and a hook portion of the hook-and-loop fastener, wherein the fixed portion is defined by the other of the loop portion and the hook portion of the hook-and-loop fastener.

5. The system of claim 1, wherein the peelable end of the pull cord extends laterally along the peelable portion of the quick-release fastener.

6. The system of claim 1, wherein the peelable end of the pull cord is a distal end of the pull cord, wherein the handle end of the pull cord is a proximal end of the pull cord that defines a user-engaging portion.

7. A system, comprising:

an article of clothing defining a vest, wherein the vest includes a shoulder region and a waist region;

a first quick-release assembly arranged upon the shoulder region of the vest; and a second quick-release assembly arranged upon the waist region of the vest, wherein the shoulder region defines a first conduit, wherein the first quick release assembly includes:

a first pull cord movably-supported upon the shoulder region, wherein a first intermediate portion of the first pull cord extends through the first conduit, wherein the first pull cord includes a first peelable end and a first handle end, wherein the first handle end is a terminal and a free end;

a first quick-release fastener including:

a first peelable portion directly connected to the first peelable end of the first pull cord; and a first fixed portion directly connected to the shoulder region of the article of clothing, wherein the first peelable portion is selectively-attached to and overlapped with the first fixed portion, wherein the first peelable end of the first pull cord that includes the first peelable portion directly connected thereto extends across the first fixed portion for permitting:

selective attachment of the first peelable portion to the first fixed portion; and selective detachment of the first peelable portion from the first fixed portion in response to a pulling force applied to the first handle end of the first pull cord, wherein the first handle end of the first pull cord extends outside of a first end of the first conduit, wherein the first peelable end of the first pull cord extends outside of a second end of the first conduit.

8. The system of claim 7, wherein the first quick-release fastener is defined by:

a first hook-and-loop fastener, wherein the first peelable portion is defined by one of:

a loop portion and a hook portion of the first hook-and-loop fastener, wherein the first fixed portion is defined by the other of the loop portion and the hook portion of the first hook-and-loop fastener.

9. The system of claim 7, wherein the first peelable end of the first pull cord is a distal end of the first pull cord, wherein the first handle end of the first pull cord is a proximal end of the first pull cord that defines a first user-engaging portion.

10. The system of claim 7, wherein the second quick release assembly includes:

an elongated strap comprising a first end, a second end, and a second quick-release fastener, the quick-release fastener having:

a second peelable portion directly connected to the first end of the elongated strap; and a second fixed portion directly connected to the second end of the elongated strap, wherein the second peelable portion is selectively-attached to and overlapped with the second fixed portion; and a second pull cord movably-supported upon the elongated strap, wherein the second pull cord includes:

a second peelable end; and a second handle end, wherein the second peelable end of the second pull cord is fastened to the second peelable portion of the second quick-release fastener, wherein the second peelable end of the pull cord that includes the peelable portion fastened thereto extends across the second fixed portion for permitting:

selective attachment of the second peelable portion to the second fixed portion; and selective detachment of the second peelable portion from the second fixed portion in response to a pulling force applied to the second handle end of the second pull cord, wherein the second pull cord is moveably-arranged within a second conduit connected to the elongated strap, wherein the second handle end of the second pull cord extends outside of a first end of the second conduit, wherein the second peelable end of the second pull cord extends outside of a second end of the second conduit, wherein the first fixed portion of the first quick-release fastener of the first quick release assembly is attached to the shoulder region, wherein the second fixed portion of the second quick-release fastener of the second quick release assembly is attached to the waist region.

11. The system of claim 10, wherein the second quick-release fastener is defined by:

a second hook-and-loop fastener, wherein the second peelable portion is defined by one of:

a loop portion and a hook portion of the second hook-and-loop fastener, wherein the second fixed portion is defined by the other of the loop portion and the hook portion of the second hook-and-loop fastener.

12. The system of claim 10, wherein the second peelable end of the second pull cord is directly fastened to the second peelable portion of the second quick-release fastener.

13. The system of claim 10, wherein the second peelable end of the second pull cord is a distal end of the second pull cord, wherein the second handle end of the second pull cord is a proximal end of the second pull cord that defines a second user-engaging portion.

14. The system of claim 10, wherein the second peelable end of the second pull cord is adjacently fastened to the second peelable portion of the second quick-release fastener.

15. A system, comprising:

a vest defining a shoulder region having a conduit;

a pull cord movably-supported upon the shoulder region, wherein an intermediate portion of the pull cord extends through the conduit, wherein the pull cord includes a peelable end and a handle end, wherein the first handle end is a terminal and a free end;

a quick-release fastener including:

a peelable portion directly connected to the peelable end of the pull cord; and a fixed portion directly connected to the shoulder region of the vest, wherein the peelable portion is selectively-attached to and overlapped with the fixed portion; and wherein the handle end of the pull cord extends outside of a first end of the conduit, wherein the peelable end of the pull cord extends outside of a second end of the conduit.

16. The system of claim 15, wherein the vest comprises a back portion and a front portion, wherein the peelable portion and the fixed portion of the quick-release fastener are arranged upon the front portion of the vest, wherein the handle end of said pull cord is movably arranged upon the front portion of the vest.

17. The system of claim 15, wherein the vest comprises a back portion and a front portion, wherein the peelable portion and the fixed portion of the quick-release fastener are arranged upon the back portion of the vest, wherein the handle end of said pull cord is movably arranged upon the front portion of the vest.

18. The system of claim 15, wherein the quick-release fastener is defined by:

a hook-and-loop fastener, wherein the peelable portion is defined by one of:

a loop portion and a hook portion of the hook-and-loop fastener, wherein the fixed portion is defined by the other of the loop portion and the hook portion of the hook-and-loop fastener.

19. The system of claim 15, wherein the peelable end of the pull cord extends laterally along the peelable portion of the quick-release fastener.

20. The system of claim 15, wherein the peelable end of the pull cord is a distal end of the pull cord, wherein the handle end of the pull cord is a proximal end of the pull cord that defines a user-engaging portion.

21. The system of claim 15, wherein the peelable portion of the quick-release fastener and the fixed portion of the quick-release fastener are defined by a plurality of selectively-attachable states including:

(1) an attached state defined by: the peelable end of the pull cord extending across the fixed portion of the quick-release fastener, and the peelable portion of the quick-release fastener being arranged directly adjacent to the fixed portion of the quick-release fastener, (2) an intermediate attached state defined by: the peelable end of the pull cord extending partially across the fixed portion of the quick-release fastener, and the peelable portion of the quick-release fastener being arranged partially directly adjacent to the fixed portion of the quick-release fastener, and (3) a detached state defined by: the peelable end of the pull cord arranged away from the fixed portion of the quick-release fastener, and the peelable portion of the quick-release fastener being arranged in a spaced-apart orientation relative to the fixed portion of the quick-release fastener.

* * * * *